US005498516A

United States Patent [19]

Kikuchi et al.

[11] Patent Number: 5,498,516

[45] Date of Patent: Mar. 12, 1996

[54] SILVER HALIDE PHOTOGRAPHIC LIGHT-SENSITIVE MATERIAL

[75] Inventors: Makoto Kikuchi; Hisashi Okamura, both of Minami-ashigara, Japan

[73] Assignee: Fuji Photo Film Co., Ltd., Kanagawa, Japan

[21] Appl. No.: 59,667

[22] Filed: May 12, 1993

[30] Foreign Application Priority Data

May 14, 1992 [JP] Japan ..... 4-146738

[51] Int. Cl.[6] ..... G03C 1/005; G03C 1/015; G03C 1/035

[52] U.S. Cl. ..... 430/567; 430/569

[58] Field of Search ..... 430/567, 569

[56] References Cited

U.S. PATENT DOCUMENTS

| | | | |
|---|---|---|---|
| 4,581,328 | 4/1986 | Matsuyama | 430/567 |
| 4,806,461 | 2/1989 | Ikeda et al. | 430/567 |
| 5,068,173 | 11/1991 | Takehara et al. | 430/567 |
| 5,389,508 | 2/1985 | Takada et al. | 430/569 |
| 5,418,124 | 5/1995 | Suga et al. | 430/569 |

FOREIGN PATENT DOCUMENTS

| | | | |
|---|---|---|---|
| 0460656 | 12/1991 | European Pat. Off. | 430/567 |
| 2-68538 | 3/1990 | Japan . | |
| 3-189642 | 8/1991 | Japan . | |

OTHER PUBLICATIONS

English Translation of JP–2–68,538.
English Translation of JP–3–189,642.
English Language Abstracts of JP–63–68,538.

*Primary Examiner*—Charles L. Bowers, Jr.
*Assistant Examiner*—Mark F. Huff
*Attorney, Agent, or Firm*—Birch, Stewart, Kolasch & Birch

[57] ABSTRACT

A silver halide photographic light-sensitive material having a silver halide emulsion layer on a support, wherein said silver halide emulsion layer contains a silver halide emulsion in which silver halide tabular grains (fringe-dislocation tabular grains), which have an aspect ratio of 2 to 40 and in which dislocation lines are localized essentially to only fringe portions, occupy 100% to 80% of a total projected area of all grains.

22 Claims, No Drawings

SILVER HALIDE PHOTOGRAPHIC LIGHT-SENSITIVE MATERIAL

BACKGROUND OF THE INVENTION

1. Field of the Invention

The present invention relates to a silver halide photographic light-sensitive material and, more particularly, to a silver halide photographic light-sensitive material having a low fog, high sensitivity, and improved response to pressure.

2. Description of the Related Art

Recently, requirements for photographic silver halide emulsions have become strict, and higher level demands have arisen for toughness, such as response to pressure, in addition to photographic properties, such as a high sensitivity and a good graininess.

Methods of manufacturing and techniques of using tabular silver halide grains are disclosed in U.S. Pat. Nos. 4,434,226, 4,439,520, 4,414,310, 4,433,048, 4,414,306, and 4,459,353. Known advantages of grains of this type are improvements in sensitivity including an improvement in spectral sensitization efficiency obtained by sensitizing dyes, an improvement in the relationship between sensitivity and graininess, an improvement in sharpness derived from specific optical properties of tabular grains, and an improvement in covering power.

JP-A-63-220238 ("JP-A" means Published Unexamined Japanese Patent Application) and JP-A-1-201649 disclose tabular silver halide grains in which dislocation lines are introduced intentionally.

It is demonstrated that tabular grains in which dislocation lines are introduced are superior in photographic characteristics, such as sensitivity and reciprocity, to those having no dislocation lines, and that the use of these grains makes it possible to improve the sharpness and the graininess of a light-sensitive material.

To further increase the sensitivity of silver halide grains, it is considered preferable that dislocation lines be introduced to a limited position at a high density in each individual grain and uniformly between grains in terms of the homogeneity of each grain, the efficiency of chemical sensitization, and the concentration of latent image formation sites.

The present invention relates to a technique of controlling introduction of dislocation lines to particularly the fringe portion of a silver halide tabular grain.

JP-A-3-189642 discloses that a silver halide emulsion with a high sensitivity and improved graininess, gradation, and fog can be obtained by using tabular silver halide grains having 10 or more dislocation lines per grain at grain fringe portions.

In the conventional dislocation introducing technique, however, such as disclosed in the above patent application, increasing the density of dislocations is inconsistent with limiting their positions.

That is, introducing dislocation lines at a higher density to the fringe portion of a tabular grain causes unintended dislocation lines at the major faces of the grain, making it impossible to introduce dislocations uniformly between individual grains.

The present inventors have tried to eliminate grains other than those having dislocation lines essentially in only their fringe portions, i.e., grains having a large number of dislocation lines in their major faces, for there is the possibility that mixing of these grains into an emulsion leads to degradation of the photographic performance (e.g., an increase in fog, a decrease in sensitivity, and a degradation in response to pressure) of the emulsion.

The present invention aims at introducing dislocation lines essentially to only a grain fringe portion in each grain, while maintaining a high density of dislocation lines, and uniformly between individual grains, thereby forming grains that cannot be reached by JP-A-3-189642.

SUMMARY OF THE INVENTION

It is an object of the present invention to provide a silver halide light-sensitive material having a low fog, a high sensitivity, and an improved response to pressure.

The above object of the present invention is achieved by the following means:

(1) A silver halide photographic light-sensitive material having a silver halide emulsion layer on a support, wherein said silver halide emulsion layer contains a silver halide emulsion in which silver halide tabular grains (fringe-dislocation tabular grains), which have an aspect ratio of 2 to 40 and in which dislocation lines are localized essentially to only fringe portions, occupy 100% to 80% of a total projected area of all grains.

(2) The silver halide photographic light-sensitive material described in item (1), wherein the silver halide tabular grains (fringe-dislocation tabular grains) are formed while iodide ions are rapidly being generated.

(3) The silver halide photographic light-sensitive material described in item (2), wherein the iodide ions are generated from an iodide ion-releasing agent placed in a reaction vessel, and 50% to 100% of the iodide ion-releasing agent completes release of iodide ions within 180 consecutive seconds in the reaction vessel.

(4) The silver halide photographic light-sensitive material described in item (2), wherein the iodide ions are generated by a reaction of an iodide ion-releasing agent with an iodide ion release-controlling agent.

(5) The silver halide photographic light-sensitive material described in item (4), wherein the reaction is a second-order reaction essentially proportional to a concentration of the iodide ion-releasing agent and a concentration of the iodide ion-release controlling agent, and a rate constant of the second-order reaction is 1,000 to $5\times10^{-3}M^{-1}sec^{-1}$.

(6) The silver halide light-sensitive material described in item (2), wherein the iodide ions are rapidly generated from an iodide ion-releasing agent represented by Formula (I) below:

Formula (I) R-I where R represents a monovalent organic residue which release the iodine atom, I, in the form of ions upon reacting with a base and/or a nucleophilic reagent.

DETAILED DESCRIPTION OF THE INVENTION

The present invention will be described in more detail below.

In a silver halide photographic light-sensitive material of the present invention, tabular silver halide grains (fringe-dislocation tabular grains) which have an aspect ratio of 2 to 40 and in which dislocation lines are localized essentially to only fringe portions occupy 100% to 80% of the total projected area of all silver halide grains contained in at least one silver halide emulsion layer.

In the present invention, tabular silver halide grains with an aspect ratio (an equivalent-circle diameter/grain thickness ratio of a silver halide grain) of 2 to 40 exists in an amount of 100% to 80% (area) of all silver halide grains contained in at least one silver halide emulsion layer.

It is more preferable that grains with an aspect ratio of 4 to 30, and most preferably 8 to 30 be present in an amount of 100% to 80% (area).

An aspect ratio of less than 2 is unpreferable because the merits of the tabular grains cannot be obtained satisfactorily. If the aspect ratio exceeds 40, the response to pressure is undesirably degraded.

If the ratio of tabular grains having an aspect ratio of 2 to 40 is less than 80% (area), the homogeneity between grains is impaired.

In the present invention, the tabular grain is a silver halide grain having two parallel major faces opposing each other.

The tabular silver halide grains of the invention have one twin plane or two or more parallel twin planes.

The twin plane is a (111) plane on both sides of which all ions at lattice points have a mirror image relationship to each other. When this tabular grain is viewed from the above, it looks like a triangle, a hexagon, or a circular triangle or hexagon. The triangular, hexagonal, and circular grains have parallel triangular, hexagonal, and circular outer surfaces, respectively.

The aspect ratio is a value obtained by dividing the diameter as circle of the projected area of a silver halide grain by its thickness.

An example of a method of measuring the aspect ratio is to measure the diameter as circle of the projected area and the thickness of each individual grain from a transmission electron micrograph according to a replica method.

In this method, the thickness is calculated from the length of the shadow of a replica.

The diameter as circle of the tabular grain of the present invention is preferably 0.3 to 10 μm, more preferably 0.4 to 5 μm, and most preferably 0.5 to 4 μm.

A diameter as circle of less than 0.3 μm is unpreferable because the merits of the tabular grains cannot be obtained satisfactorily. If the diameter as circle exceeds 10 μm, the response to pressure is undesirably impaired.

The grain thickness of the tabular grain of the present invention is preferably 0.05 to 1.0 μm, more preferably 0.08 to 0.5 μm, and most preferably 0.08 to 0.3 μm.

If the grain thickness is less than 0.05 μm, the response to pressure is undesirably degraded. A grain thickness exceeding 1.0 μm is unpreferable because the merits of the tabular grains cannot be obtained satisfactorily.

In the present invention, it is preferable that hexagonal tabular grains, in which the ratio of the length of the longest side of a hexagon to the length of its shortest side is 2 to 1, occupy 100% to 50%, more preferably 100% to 70%, and most preferably 100% to 90% of the total projected area of all grains in an emulsion.

It is also preferable that the emulsion of the present invention be monodisperse.

The variation coefficient of the grain size distribution of all silver halide grains of the present invention is preferably 20% to 3%, more preferably 15% to 3%, and most preferably 10% to 3%.

The variation coefficient of the grain size distribution is a value obtained by dividing the standard deviation of the grain size distribution of grains by their average grain size.

The tabular grain of the present invention has dislocation lines.

A dislocation line is a linear lattice defect at the boundary between a region already slipped and a region not slipped yet on a slip plane of crystal.

Dislocation lines in silver halide crystal are described in, e.g., 1) C. R. Berry, J. Appl. Phys., 27, 636 (1956), 2) C. R. Berry, D. C. Skilman, J. Appl. Phys., 35, 2165 (1964), 3), J. F. Hamilton, Phot. Sci. Eng., 11, 57 (1967), 4) T. Shiozawa, J. Soc. Phot. Sci. Jap., 34, 16 (1971), and 5) T. Shiozawa, J. Soc. Phot. Sci. Jap., 35, 213 (1972). Dislocation lines can be analyzed by an X-ray diffraction method or a direct observation method using a low-temperature transmission electron microscope.

When observing the dislocations directly using the transmission electron microscope, silver halide grains, extracted carefully from an emulsion so as not to apply a pressure at which dislocations are produced in the grains, are placed on a mesh for electron microscopic observation. Observation is performed by a transmission method while the sample is cooled to prevent damage (e.g., print out) due to electron rays. In this case, as the thickness of a grain is increased, it becomes more difficult to transmit electron rays through it. Therefore, grains can be observed more clearly by using an electron microscope of a high voltage type (200 kV or more for a grain having a thickness of 0.25 μm).

In the case of the tabular grains, from photographs of grains obtained by the above method, it is possible to obtain the positions and the number of dislocations in each grain viewed in a direction perpendicular to the major faces of the grain.

Note that dislocation lines can or cannot be seen depending on the angle of inclination of a sample with respect to electron rays. Therefore, in order to obverse dislocation lines without omission, it is necessary to obtain the positions of dislocation lines by observing photographs of the same grain taken at as many sample inclination angles as possible.

In the present invention, five photographs of the same grain are preferably taken at inclination angles different by a 5° step by using a high-voltage electron microscope, thereby obtaining the positions and the number of dislocation lines.

The fringe-dislocation tabular grains of the present invention have preferably 30 or more, more preferably 50 or more, and most preferably 100 or more dislocations lines per grain in grain fringe portions.

Not more than 30 of dislocation lines is not preferable because it is difficult to obtain the effect of the present invention.

If dislocation lines are densely present or cross each other, it is sometimes impossible to accurately count the dislocation lines per grain.

Even in these situations, however, dislocation lines can be roughly counted to such an extent as in units of 10 lines.

In the present invention, as described above, the fringe-dislocation tabular grains mean particularly high-density fringe-dislocation grains having preferably 30 or more dislocation lines per grain.

In the present invention, the "fringe portion" means the peripheral region of a tabular grain. More specifically, the fringe portion is a region outside a certain position where, in a distribution of silver iodide from the edge to the center of a tabular grain, a silver iodide content from the edge side exceeds or becomes lower than the average silver iodide content of the overall grain for the first time.

In the present invention, a grain having dislocation lines essentially in only its fringe portion means a tabular grain (to be referred to as a fringe-dislocation tabular grain hereinafter) not containing more than three dislocation lines in a portion except its fringe portion, i.e., in its major faces. Among the high-density fringe-dislocation grains, grains having three or more dislocation lines in their major faces are distinguished from the fringe-dislocation tabular grains (these grains will be referred to as major face-dislocation tabular grains hereinafter).

The ratios accounted for by the fringe-dislocation tabular grains and the major face-dislocation tabular grains in emulsion grains are preferably obtained by directly observing dislocation lines of at least 200 emulsion grains.

In the present invention, fringe-dislocation tabular grains having an aspect ratio of 2 to 4 occupy 100% to 80%, more preferably 100% to 85% and most preferably 100% to 90% of the total projected area of all silver halide grains.

In the present invention, a particularly startling effect can be obtained when grains are formed while iodide ions are rapidly being generated from an iodide ion-releasing agent represented by Formula (I).

An iodide ion-releasing agent represented by Formula (I) of the present invention overlaps in part compounds used to obtain a uniform halogen composition in each silver halide grain and between individual grains in JP-A-2-68538.

It is, however, totally unexpected for the present inventors to find that a silver halide emulsion having a low fog, and a high sensitivity, can be obtained by performing formation of silver halide grains while iodide ions are rapidly being generated from an iodide ion-releasing agent represented by Formula (I).

An iodide ion releasing agent represented by Formula (I) below of the present invention will be described in detail.

Formula (I)

R-I where R represents a monovalent organic residue which releases the iodine atom, I, in the form of iodide ions upon reacting with a base and/or a nucleophilic reagent.

The details of a compound represented by Formula (I) will be described. Preferable examples of R are an alkyl group having 1 to 30 carbon atoms, an alkenyl group having 2 to 30 carbon atoms, an alkynyl group having 2 or 3 carbon atoms, an aryl group having 6 to 30 carbon atoms, an aralkyl group having 7 to 30 carbon atoms, a heterocyclic group having 4 to 30 carbon atoms, an acyl group having 1 to 30 carbon atoms, a carbamoyl group, an alkyl or aryloxycarbonyl group having 2 to 30 carbon atoms, an alkyl or arylsulfonyl group having 1 to 30 carbon atoms, and a sulfamoyl group.

R is preferably one of the above groups having 20 or less carbon atoms, and most preferably one of the above groups having 12 or less carbon atoms.

Groups each having the number of carbon atoms, which falls within this range, are preferable in view of their solubility and the amount in which they are used.

Specifical examples of R are an alkyl group (e.g., methyl, ethyl, n-propyl, isopropyl, t-butyl, n-octyl, cyclopentyl, and cyclohexyl), an alkenyl group (e.g., allyl, 2-butenyl, and 3-pentenyl), an alkynyl group (e.g., propargyl and 3-pentynyl), an aralkyl group (e.g., benzyl and phenethyl), an aryl group (e.g., phenyl, naphthyl, and 4-methylphenyl), and a heterocyclic group (e.g., pyridyl, furyl, imidazolyl, piperidyl, and morpholyl).

It is also preferable that R be substituted, and examples of preferable substituents are as follows. These substituents may be further substituted by other substituents.

Examples are a halogen atom (e.g., fluorine, chlorine, bromine, and iodine), an alkyl group (e.g., methyl, ethyl, n-propyl, isopropyl, t-butyl, n-octyl, cyclopentyl, and cyclohexyl), an alkenyl group (e.g., allyl, 2-butenyl, and 3-pentenyl), an alkynyl group (e.g., propargyl and 3-pentynyl), an aralkyl group (e.g., benzyl and phenethyl), an aryl group (e.g., phenyl, naphthyl, and 4-methylphenyl), a heterocyclic group (e.g., pyridyl, furyl, imidazolyl, piperidyl, and morpholyl), an alkoxy group (e.g., methoxy, ethoxy, and butoxy), an aryloxy group (e.g., phenoxy and naphthoxy), an amino group (e.g., unsubstituted amino, dimethylamino, ethylamino, and anilino), an acylamino group (e.g., acetylamino and benzoylamino), a ureido group (e.g., unsubstituted ureido, N-methylureido, and N-phenylureido), a urethane group (e.g., methoxycarbonylamino and phenoxycarbonylamino), a sulfonylamino group (e.g., methylsulfonylamino and phenylsulfonylamino), a sulfamoylamino group (e.g., sulfamoyl, N-methylsulfamoyl, and N-phenylsulfamoyl), a carbamoyl group (e.g., carbamoyl, diethylcarbamoyl, and phenylcarbamoyl), a sulfonyl group (e.g., methylsulfonyl and benzenesulfonyl), a sulfinyl group (e.g., methylsulfinyl and phenylsulfinyl), an alkyloxycarbonyl group (e.g., methoxycarbonyl and ethoxycarbonyl), an aryloxycarbonyl group (e.g., phenoxycarbonyl), an acyl group (e.g., acetyl, benzoyl, formyl, and pivaloyl), an acyloxy group (e.g., acetoxy and benzoyloxy), an amido-phosphoryl group (e.g., N,N-diethylamido-phosphoryl), an alkylthio group (e.g., methylthio and ethylthio), an arylthio group (e.g., a phenylthio group), a cyano group, a sulfo group, a carboxyl group, a hydroxy group, a phosphono group, and a nitro group.

More preferable substituents for R are a halogen atom, an alkyl group, an aryl group, a 5- or 6-membered heterocyclic group containing at least one O, N, or S, an alkoxy group, an aryloxy group, an acylamino group, a sulfamoyl group, a carbamoyl group, an alkylsulfonyl group, an arylsulfonyl group, an aryloxycarbonyl group, an acyl group, a sulfo group, a carboxyl group, a hydroxy group, and a nitro group.

Most preferable substituents for R are a hydroxy group, a carbamoyl group, a lower alkylsulfonyl group, and a sulfo group (including its salt), when substituted on an alkylene group, and a sulfo group (including its salt), when substituted on a phenylene group.

A compound represented by Formula (I) of the present invention is preferably a compound represented by Formula (II) or (III) below.

A compound represented by Formula (II) of the present invention will be described below.

Formula (II)

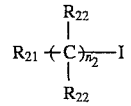

In Formula (II), $R_{21}$ represents an electron-withdrawing group, and $R_{22}$ represents a hydrogen atom or a substitutable group.

$n_2$ represents an integer from 1 to 6. $n_2$ is preferably an integer from 1 to 3, and most preferably 1 or 2.

The electron-withdrawing group represented by $R_{21}$ is preferably an organic group having a Hammett $\sigma_p$, $\sigma_m$, or $\sigma_I$ value larger than 0.

The Hammett $\sigma_p$ or $\sigma_m$ value is described in "Structural Activity Correlation of Chemicals" (Nanko Do), page 96 (1979), and the Hammett $\sigma_I$ value is described in the same literature, page 105. So the values can be selected on the basis of these tables.

Preferable examples of $R_{21}$ are a halogen atom (e.g., fluorine, chlorine, and bromine), a trichloromethyl group, a cyano group, a formyl group, a carboxylic acid group, a sulfonic acid group, a carbamoyl group (e.g., unsubstituted carbamoyl and diethylcarbamoyl), an acyl group (e.g., acetyl and benzoyl), an oxycarbonyl group (e.g., methoxycarbonyl and ethoxycarbonyl), a sulfonyl group (e.g., methanesulfonyl and benzenesulfonyl), a sulfonyloxy group (e.g., methanesulfonyloxy), a carbonyloxy group (e.g., acetoxy), a sulfamoyl group (e.g., unsubstituted sulfamoyl and dimethylsulfamoyl), and a heterocyclic group (e.g., 2-thienyl, 2-benzoxazolyl, 2-benzothiazolyl, 1-methyl-2-benzimidazolyl, 1-tetrazolyl, and 2-quinolyl). Carbon-containing groups of $R_{21}$ preferably contain 1 to 20 carbon atoms.

Examples of the substitutable group represented by $R_{22}$ are those enumerated above as the substituents for R. A plurality of $R_{22}$'s present in a molecule may be the same or different.

It is preferable that one-half or more of a plurality of $R_{22}$'s contained in a compound represented by Formula (II) be hydrogen atoms.

$R_{21}$ and $R_{22}$ may be further substituted. Preferable examples of the substituents are those enumerated above as the substituents for R.

Also, $R_{21}$ and $R_{22}$ or two or more $R_{22}$'s may combine together to form a 3- to 6-membered ring.

A compound represented by Formula (III) of the present invention will be described below.

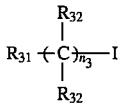

Formula (III)

In Formula (III), $R_{31}$ represents an $R_{33}O$— group, an $R_{33}S$— group, an $(R_{33})_2N$— group, an $(R_{33})_2P$— group, or phenyl, wherein $R_{33}$ represents a hydrogen atom, an alkyl group having 1 to 30 carbon atoms, an alkenyl group having 2 to 30 carbon atoms, an alkynyl group having 2 or 3 carbon atoms, an aryl group having 6 to 30 carbon atoms, an aralkyl group having 7 to 30 carbon atoms, or a heterocyclic group having 4 to 30 carbon atoms.

Groups each having the number of carbon atoms, which falls within this range, are preferable in view of their solubility and the amount in which they are used.

If $R_{31}$ represents the $(R_{33})_2N$— group or the $(R_{33})_2P$— group, two $R_{33}$ groups may be the same or different.

$R_{32}$ and $n_3$ have the same meanings as $R_{22}$ and n2 in Formula (II), and a plurality of $R_{32}$'s may be the same or different.

Examples of the substitutable group represented by $R_{32}$ are those enumerated above as the substituents for R. $R_{32}$ preferably represent a hydrogen atom.

$n_3$ is preferably 1, 2, 4, or 5, and more preferably, 2.

$R_{31}$ and $R_{32}$ may be further substituted. Preferable examples of the substituents are those enumerated above as the substituents for R.

Also, $R_{31}$ and $R_{32}$, or two or more $R_{32}$'s may bond together to form a ring.

Practical examples of compounds represented by Formulas (I), (II), and (III) of the present invention will be described below, but the present invention is not limited to these examples.

$ICH_2COOH$ (1)
$ICH_2CONH_2$ (2)
$ICH_2CN$ (3)
$I(CH_2)_2COOH$ (4)
$I(CH_2)_3COOH$ (5)

-continued

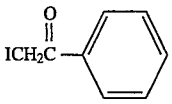

(6)

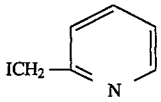

(7)

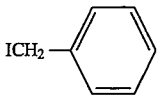

(8)

$I(CH_2)_2SO_3Na$ (9)
$I(CH_2)_2SO_2CH_3$ (10)
$I(CH_2)_2OH$ (11)
$I(CH_2)_3OH$ (12)
$I(CH_2)_4OH$ (13)

$ICH_2CHOH$ (14)
$CH_3$ $ICH_2CHOH$ (15)

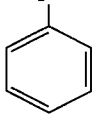

$ICH_2CHCH_2OH$ (16)
OH $ICH_2CHCH_2SO_3NA$ (17)
OH

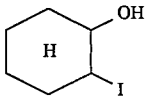

(18)

$ICH_2CHCHCH_2I$ (19)
OHOH

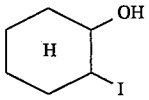

(20)

ICHCOOH (21)

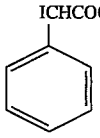

$I(CH_2)_2SO_2CH_2CONH_2$ (22)
$I(CH_2)_2NH_2$ (23)
$I(CH_2)_2NHSO_2CH_3$ (24)
$I(CH_2)_2NHCOCH_3$ (25)
$I(CH_2)_2OCH_3$ (26)
$I(CH_2)_2SCH_3$ (27)

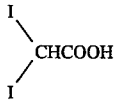

(28)

$ICH_2CHCH_2I$ (29)
OH $I(CH_2)_2SO_2NH_2$ (30)

-continued
(31)
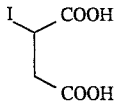
(32)
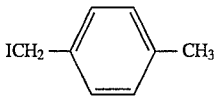
(33)
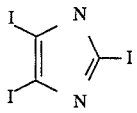
(34)
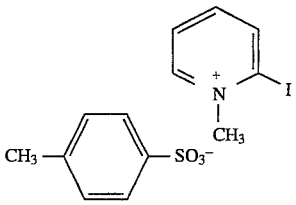
(35)
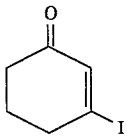
(36)
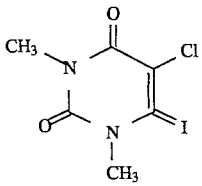
(37)
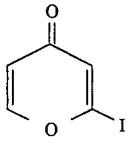
(38)
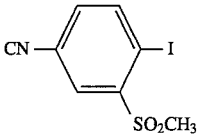
(39)
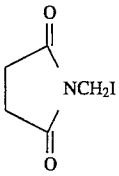
(40)
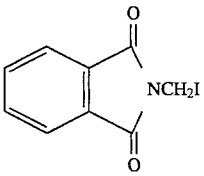
(41)
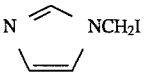
-continued
(42)
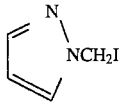
(43)
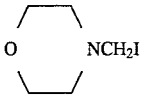
(44)
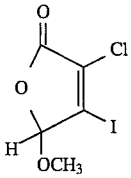
(45)
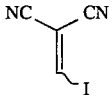
(46)
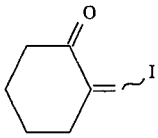
$I(CH_2)_5COOH$ (47)
(48)
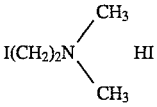
$I(CH_2)_2NCH_3SO_2CH_3$ (49)
$I(CH_2)_2OCOCH_3$ (50)
$I(CH_2)_2NCH_3COCH_3$ (51)
(52)
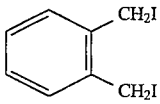
(53)
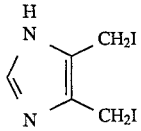
(54)
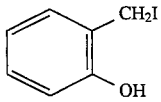
(55)
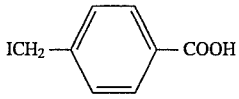
(56)
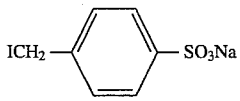
$ICH_2CONH(CH_2)_2-SO_3Na$ (57)
(58)
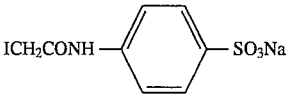

-continued (59)

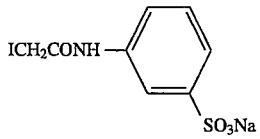

(60)

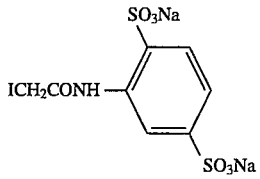

(61)

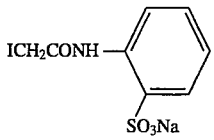

(62)

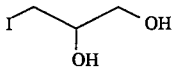

(63)

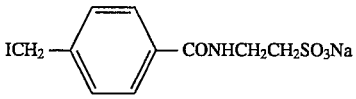

(64)

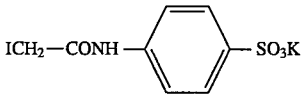

(65)

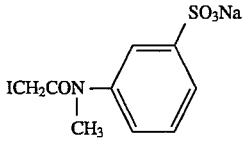

(66)

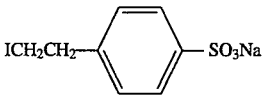

(67)

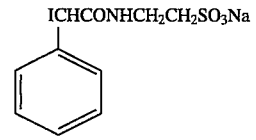

(68)

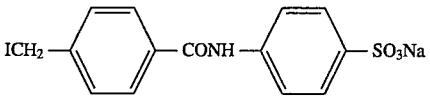

(69)

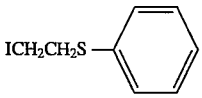

The iodide ion-releasing agent of the present invention can be synthesized in accordance with the following synthesizing methods:

J. Am. Chem. Soc., 76, 3227–8 (1954), J. Org. Chem., 16,798 (1951), Chem. Ber., 97, 390 (1964), Org. Synth., V, 478 (1973), J. Chem. Soc., 1951, 1851, J. Org. Chem., 19, 1571 (1954), J. Chem. Soc., 1952, 142, J. Chem. Soc., 1955, 1383, Angew, Chem., Int. Ed., 11, 229 (1972), Chem Commu., 1971, 1112.

The iodide ion-releasing agent of the present invention releases iodide ion upon reacting with an iodide ion release-controlling agent (a base and/or a nucleophilic reagent). Preferable examples of the nucleophilic reagent for this purpose are chemical species listed below:

Hydroxide ion, sulfite ion, hydroxylamine, thiosulfate ion, metabisulfite ion, hydroxamic acids, oximes, dihydroxybenzenes, mercaptanes, sulfinate, carboxylate, ammonia, amines, alcohols, ureas, thioureas, phenols, hydrazines, hydrazides, semicarbazides, phosphines, and sulfides.

In the present invention, the rate and timing at which iodide ions are released can be controlled by controlling the concentration of a base or a nucleophilic reagent, the addition method, or the temperature of a reaction solution. A preferable example of the base is alkali hydroxide.

The range of concentration of the iodide ion-releasing agent and the iodide ion release-controlling agent for use in the rapid production of iodide ions is preferably $1\times10^{-7}$ to 20M, more preferably $1\times10^{-5}$ to 10M, further preferably $1\times10^{-4}$ to 5M, and most preferably $1\times10^{-3}$ to 2M.

If the concentration exceeds 20M, the total amount of the iodide ion-releasing agent and the iodide ion release-controlling agent, both having a great molecular weight, will be excessive for the volume of the grain formation vessel used. On the other hand, if the concentration is less than $1\times10^{-7}$M, the rate of reaction of releasing iodide ions will be too low, making it difficult to produce iodide ions rapidly.

The range of temperature is preferably 30° to 80° C., more preferably 35° to 75° C., and most preferably 35° to 60° C.

Generally, the rate of reaction of releasing iodide ions is too high at high temperatures over 80° C., and is too low at low temperatures below 30° C. The temperature range within which to use the iodide ion-releasing agent is therefore limited.

In the present invention, changes in pH of the solution can be used if the base is used in releasing iodide ions.

In this case, the range of pH for controlling the rate and timing at which iodide ions are released is preferably 2 to 12, more preferably 3 to 11, and particularly preferably 5 to 10. The pH is most preferably 7.5 to 10.0 after the control. Hydroxide ion determined by the ion product of water serves as a control agent even under a neutral condition of pH 7.

It is also possible to use the nucleophilic reagent and the base together. Here again, the rate and timing at which iodide ion is released may be controlled by controlling the pH within the above range.

The range of amount of iodide ions released from the iodide ion-releasing agent is preferably 0.1 to 20 mole %, more preferably 0.3 to 15 mole %, and most preferably 1 to 10 mole % with respect to the total amount of the silver halides.

The iodide ions can be released in any amount ranging from 0.1 to 20 mole % that is suitable for the purpose the ions are used. If the amount exceeds 20 mole %, however, the development speed will decrease in most cases.

when iodine atoms are to be released in the form of iodide ions from the iodide ion-releasing agent, iodine atoms may be either released completely or partially left undecomposed.

The rate at which iodide ions are released from the iodide ion-releasing agent will be described below by way of practical examples.

In the present invention, it is preferable to form a silver halide phase containing silver iodide on the edges of a tabular grain while iodide ions are rapidly being generated during the process of introducing dislocation lines into the tabular grain, in order to introduce dislocation lines at a high density.

If the supply rate of iodide ions is too low, i.e., if the time required to form a silver halide phase containing silver iodide is too long, the silver halide phase containing silver iodide dissolves again during the formation, and the dislocation density decreases.

On the other hand, supplying iodide ions slowly is preferable in performing grain formation such that no nonuniformity is produced in a distribution of dislocations between individual grains.

It is therefore important that iodide ions be rapidly generated without causing any locality (nonuniform distribution).

when an iodide ion-releasing agent or an iodide ion release-controlling agent to be used together therewith is added through an inlet to a reaction solution placed in a grain formation vessel, a locality with a high concentration of added agent may be formed near the inlet. Thus, correspondingly, a locality of generated iodide ions is produced, since an iodide ion release reaction proceeds very quickly.

The rate at which iodide ions released is deposited on a host grain is very high, and grain growth occurs in a region near the addition inlet where the locality of the iodide ions is large. The result is grain growth nonuniform between individual grains.

Therefore, the iodide ion-releasing rate must be selected so as not to cause locality of iodide ions.

In conventional methods (e.g., a method of adding an aqueous potassium iodide solution), iodide ions are added in a free state even when an aqueous potassium iodide solution is diluted before the addition. This limits the reduction in locality of iodide ions.

That is, it is difficult for the conventional methods to perform grain formation without causing nonuniformity between grains.

The present invention, however, which can control the iodide ion-releasing rate, makes it possible to reduce the locality of iodide ions compared to the conventional methods.

The present inventors predicted that it is impossible to limitedly introduce high-density dislocations essentially to only fringe portions in each individual grain and uniformly between grains by using a conventional iodide ion supply method in which the locality of iodide ions is large. Therefore, the present inventors tried to introduce dislocations to tabular grains by using a method of rapidly generating iodide ions, in which the locality of iodide ions is small. Consequently, the present inventors found that dislocation lines can be limitedly introduced essentially to only fringe portions of tabular grains in each individual grain and uniformly between grains while maintaining the high density of dislocation lines.

In the present invention, the iodide ion-releasing rate can be determined by controlling the temperature and the concentrations of the iodide ion-releasing agent and the iodide ion release-controlling agent and therefore can be selected in accordance with the intended use.

In the present invention, a preferable iodide ion-releasing rate is the one at which 50 to 100% of the total weight of the iodide ion-releasing agent present in a reaction solution in a grain formation vessel complete release of iodide ion within 180 consecutive seconds, more preferably within 120 consecutive seconds, and most preferably within 60 consecutive seconds.

Preferably, the iodide ions should be released over at least 1 second.

The words "180 consecutive seconds" means a period for which the reaction of releasing iodide ions continues. The iodide ion-releasing period may be measured, starting at any time during the continuous reaction. If the iodide ions are released during two or more periods, set apart from one another, the iodide ion-releasing period may be measured, starting at any time during the first period or any other period. The ion releasing rate may be determined at said time during the first period or any other period.

"Completion of release of iodide ions" means that all the iodine contained in a particular iodide ion-releasing agent is released from the releasing agent in the form of ions. For example, in the case of an iodide ion-releasing agent having one iodine in the molecule, the release of iodide ions is completed when the one iodine is released from the releasing agent. In the case of an iodine ion-releasing agent having two or more iodines in the molecule, the release of iodide ions is completed when all of the two or more iodines are released therefrom.

A releasing rate at which the time exceeds 180 seconds is generally low, and a releasing rate at which the time exceeds less than 1 second is generally fast, and so its use conditions are limited. This similarly applies to a releasing rate at which the amount of the iodide ion-releasing agent is less than 50%.

A more preferable rate is the one at which 100 to 70% of the iodide ion-releasing agent present in a reaction solution in a grain formation vessel complete release of iodide ion within 180 consecutive seconds. The rate is further preferably the one at which 100 to 80%, and most preferably 100 to 90% complete release of iodide ion within 180 consecutive seconds.

When the reaction of rapidly producing iodide ions is represented by a second-order reaction essentially proportional to the concentration of the iodide ion-releasing agent and that of the iodide ion release-controlling agent (under water, 40° C.), the rate constant of the second-order reaction in the present invention is preferably 1,000 to $5\times10^{-3}$ ($M^{-1}\cdot sec^{-1}$), more preferably 100 to $5\times10^{-2}$ ($M^{-1}\cdot sec^{-1}$), and most preferably 10 to 0.1 ($M^{-1}\cdot sec^{-1}$).

The "second-order reaction" means that the coefficient of correlation is 1.0 to 0.8. The following is representative examples of a second-order reaction rate constant k ($M^{-1}\cdot sec^{-1}$) measured under the conditions considered to be a pseudo first-order reaction: the concentration of the iodide ion-releasing agent ranging from $10^{-4}$ to $10^{-5}$M, the concentration of the iodide ion release control agent ranging from $10^{-1}$ to $10^{-4}$M, under water, and 40° C.

| Compound No. | Iodide ion release-controlling agent | k |
|---|---|---|
| 11 | Hydroxide ion | 1.3 |
| 1 | Sulfite ion | $1\times10^{-3}$ or less |
| 2 | " | 0.29 |
| 58 | " | 0.49 |
| 63 | " | 1.5 |
| 22 | Hydroxide ion | 720 |

If k exceeds 1,000, the release is too fast to control; if it is less than $5\times10^{-3}$, the release is too slow to obtain the effect of the present invention.

The following method is favorable to control the release of iodide ions in the present invention.

That is, this method allows the iodide ion-releasing agent, added to a reaction solution in a grain formation vessel and already distributed uniformly, to release iodide ions uniformly throughout the reaction solution by changing the pH, the concentration of a nucleophilic substance, or the temperature, normally by changing from a low pH to a high pH.

It is preferable that alkali for increasing the pH during release of iodide ions and the nucleophilic substance be added in a condition in which the iodide ion-releasing agent is distributed uniformly throughout the reaction solution.

More specifically, in the present invention, iodide ions, which are to react with silver ions, are rapidly generated in a reaction system in order to form silver halide grains containing silver iodide (e.g., silver iodide, silver bromoiodide, silver bromochloroiodide, or silver chloroiodide). In most cases, the iodide ion-releasing agent of this invention is added, if necessary along with another halogen ion source (e.g., KBr), to the reaction system which uses, as a reaction medium, an aqueous gelatin solution containing silver ions due to addition of, for example, silver nitrate, or containing silver halide grains (e.g., silver bromoiodide grains), and the iodide ion-releasing agent is distributed uniformly in the reaction system by a known method (such as stirring). At this stage the reaction system has a low pH value and is weakly acidic, and the iodide ion-releasing agent does not release iodide ions rapidly.

An alkali (e.g., sodium hydroxide or sodium sulfite) is then added, as an iodide ion release-controlling agent, to the reaction system, thereby increasing the pH of the system to the alkaline side (preferably, to 7.5 to 10). As a result, iodide ions are rapidly released from the iodide ion-releasing agent. The iodide ions react with the silver ions or undergo halogen conversion with the silver halide grains, thus forming a silver iodide-containing region.

As has been indicated, the reaction temperature usually ranges from 30° to 80° C., more preferably 35° to 75° C., and most preferably 35° to 60° C. The iodide ion-releasing agent releases iodide ions usually at such a rate that 50 to 100% of the agent completes release of iodide ions within a consecutive period of 1 second to 180 seconds, starting at the time of adding the alkali. To make the iodide ion-releasing agent to release iodide ions at such a rate, which iodide ion-releasing agent and which iodide ion release-controlling agent should be used in combination in which amounts they should be used are determined in accordance with the second-order reaction rate constant described above.

In order to distribute the alkali uniformly in the reaction system (that is, to produce silver iodide uniformly), it is desirable that the alkali be added while the reaction system is being vigorously stirred by means of, for example, controlled double jet method.

A method of introducing dislocation lines to tabular grains of the present invention will be described below.

The tabular grain of the present invention consists of a silver halide containing silver iodide. The tabular grain of the present invention contains at least one of a silver iodide phase, a silver bromoiodide phase, a silver bromochloroiodide phase, and a silver iodochloride phase. The silver halide grain may contain another silver salt, such as silver rhodanate, silver sulfide, silver selenide, silver carbonate, silver phosphate, or an organic acid silver, as another grain or as a portion of the grain.

The silver iodide content of the tabular grain of the present invention is preferably 0.1 to 20 mol %, more preferably 0.3 to 15 molt, and most preferably 1 to 10 mol %.

In the present invention, it is preferable to introduce dislocation lines inside tabular grains as follows.

That is, tabular grains serving as substrate grains are prepared first and then a silver halide phase containing silver iodide is formed on the edge portion of each substrate grain.

In this method, the effect of the present invention was significant when a compound of the present invention represented by Formula (I) was used as an iodide ion supply source.

Although the silver halide region containing silver iodide may have any given halogen composition, its silver iodide content is preferably as high as possible.

The silver iodide content of the substrate grain is preferably 0 to 15 mol %, more preferably 0 to 12 mol %, and most preferably 0 to 10 mol %.

A halogen amount added to form this silver iodide rich region on the substrate grain is preferably 2 to 15 mol %, more preferably 2 to 10 mol %, and most preferably 2 to 5 mol % of the silver amount of the substrate grain.

In this case, the amount of this silver iodide rich region falls within a range of preferably 5 to 80 mol %, more preferably 10 to 70 mol %, and most preferably 20 to 60 mol % of the silver amount of the entire grain.

After the silver iodide rich region is formed on the edge portion of the substrate grain, dislocation lines can be introduced by forming a silver halide shell outside the phase.

Although the composition of this silver halide shell is any of silver bromide, silver bromoiodide, and silver bromochloroiodide, it is preferably silver bromide or silver bromoiodide.

When the composition of the silver halide shell is silver bromoiodide, the silver iodide content is preferably 0.1 to 12 mol %, more preferably 0.1 to 10 mol %, and most preferably 0.1 to 3 mol %.

The temperature during the above process of introducing dislocation lines is preferably 30° to 80° C., more preferably 35° to 75° C., and most preferably 35° to 60° C.

The pAg during the process is preferably 6.4 to 10.5.

In addition, it is preferable to form the outermost shell near the surface of a silver halide grain uniformly in each individual grain and between grains by using the iodide ion releasing method of the present invention.

Forming the silver halide region containing silver iodide near the grain surface is important in enhancing the adsorbability to dyes and controlling the rate of development.

In the present invention, the grain surface is a region from the surface to a depth of about 50 Å.

A halogen composition in such a region can be analyzed by surface analysis methods, such as XPS (X-ray Photoelectron Spectroscopy) and ISS (Ion Scattering Spectroscopy).

In the present invention, the silver iodide content of the silver halide region on the grain surface of an emulsion grain, measured by these surface analysis methods, is preferably 0.1 to 15 mol %, more preferably 0.3 to 12 mol %, particularly preferably 1 to 10 mol %, and most preferably 3 to 8 mol %.

It is also preferable in the present invention that the halogen composition be uniform between grains.

In the emulsion of the present invention, the variation coefficient of the distribution of the silver iodide contents of individual grains is preferably 20% to 3%, more preferably 15% to 3%, and most preferably 10% to 3%.

The silver iodide contents of individual grains can be measured by analyzing the composition of each grain by using an X-ray microanalyzer.

The variation coefficient of the distribution of silver iodide contents is a value obtained by dividing the variation (standard deviation) in silver iodide contents of individual grains by their average silver iodide content.

The emulsions of the present invention and other emulsions used together with those of the present invention will be described below.

The silver halide grain for use in the present invention consists of silver bromide, silver chloride, silver iodide, silver chlorobromide, silver iodochloride, silver bromoiodide, or silver bromochloroiodide. The silver halide grain may contain another silver salt, such as silver rhodanate, silver sulfide, silver selenide, silver carbonate, silver phosphate, or an organic acid silver, as another grain or as a portion of the grain.

The silver halide emulsion of the present invention preferably has a distribution or a structure associated with a halogen composition in its grains. A typical example of such a grain is a core-shell or double structure grain having different halogen compositions in its interior and surface layer as disclosed in, e.g., JP-B-43-13162 ("JP-B" means Published Examined Japanese Patent Application), JP-A-61-215540, JP-A-60-222845, JP-A-60-143331, or JP-A-61-75337. The structure need not be a simple double structure but may be a triple structure or a multiple structure larger than the triple structure as disclosed in JP-A-60-222844. It is also possible to bond a thin silver halide having a different composition from that of a core-shell double-structure grain on the surface of the grain.

The structure to be formed inside a grain need not be the surrounding structure as described above but may be a so-called junctioned structure. Examples of the junctioned structure are disclosed in JP-A-59-133540, JP-A-58-108526, EP 199,290A2, JP-B-58-24772, and JP-A-59-16254. A crystal to be Junctioned can be formed on the edge, the corner, or the face of a host crystal to have a different composition from that of the host crystal. Such a junctioned crystal can be formed regardless of whether a host crystal is uniform in halogen composition or has a core-shell structure.

In the case of the junctioned structure, it is naturally possible to use a combination of silver halides. However, it is also possible to form the junctioned structure by combining a silver halide and a silver salt compound not having a rock salt structure, such as silver rhodanate or silver carbonate. In addition, a non-silver salt compound, such as lead oxide, can also be used provided that formation of the junctioned structure is possible.

In a silver bromoiodide grain having any of the above structures, it is preferable that the silver iodide content in a core portion be higher than that in a shell portion. In contrast, it is sometimes preferable that the silver iodide content in the core portion be low and that in the shell portion be high. Similarly, in a junctioned-structure grain, the silver iodide content may be high in a host crystal and low in a junctioned crystal and vice versa. The boundary portion between different halogen compositions in a grain having any of the above structures may be either definite or indefinite. It is also possible to positively form a continuous composition change.

In a silver halide grain in which two or more silver halides are present as a mixed crystal or with a structure, it is important to control the distribution of halogen compositions between grains. A method of measuring the distribution of halogen compositions between grains is described in JP-A-60-254032. A uniform halogen distribution between grains is a desirable characteristic. In particular, a highly uniform emulsion having a variation coefficient of 20% or less is preferable. An emulsion having a correlation between a grain size and a halogen composition is also preferable. An example of the correlation is that larger grains have higher iodide contents and smaller grains have lower iodide contents. An opposite correlation or a correlation with respect to another halogen composition can also be selected in accordance with the intended use. For this purpose, it is preferable to mix two or more emulsions having different compositions.

It is important to control the halogen composition near the surface of a grain. Increasing the silver iodide content or the silver chloride content near the surface can be selected in accordance with the intended use because this changes a dye absorbing property or a developing rate. In order to change the halogen composition near the surface, it is possible to select either the structure in which a grain is entirely surrounded by a silver halide or the structure in which a silver halide is adhered to only a portion of a grain. For example, a halogen composition of only one of a (100) face and a (111) face of a tetradecahedral grain may be changed, or a halogen composition of one of a major face or a side face of a tabular grain may be changed.

Silver halide grains for use in the present invention can be selected in accordance with the intended use. Examples are a regular crystal not containing a twin plane and crystals explained in Japan Photographic Society ed., The Basis of Photographic Engineering, Silver Salt Photography (CORONA PUBLISHING CO., LTD.), page 163, such as a single twined crystal containing one twin plane, a parallel multiple twined crystal containing two or more parallel twin planes, and a nonparallel multiple twined crystal containing two or more nonparallel twin planes. A method of mixing grains having different shapes is disclosed in U.S. Pat. No. 4,865,964. So this method can be selected as needed. In the case of a regular crystal, it is possible to use a cubic grain constituted by (100) faces, an octahedral grain constituted by (111) faces, or a dodecahedral grain constituted by (110) faces disclosed in JP-B-55-42737 or JP-A-60-222842. It is also possible to use, in accordance with the intended use of an emulsion, an (h11) face grain represented by a (211) face grain, an (hh1) face grain represented by a (331) face grain, an (hk0) face grain represented by a (210) face grain, or an (hk1) face grain represented by a (321) face grain, as reported in Journal of Imaging Science, Vol. 30, page 247, 1986, although the preparation method requires some improvements. A grain having two or more different faces, such as a tetradecahedral grain having both (100) and (111) faces, a grain having (100) and (110) faces, or a grain having (111) and (110) faces can also be used in accordance with the intended use of an emulsion.

A value obtained by dividing the equivalent-circle diameter of the projected area of a grain by the thickness of that grain is called an aspect ratio that defines the shape of a tabular grain. Tabular grains having aspect ratios higher than 1 can be used in the present invention. Tabular grains can be prepared by the methods described in, e.g., Cleve, Photography Theory and Practice (1930), page 131; Gutoff, Photographic Science and Engineering, Vol. 14, pages 248 to 257, (1970); and U.S. Pat. Nos. 4,434,226, 4,414,310, 4,433,048, and 4,439,520, and British Patent 2,112,157. The use of tabular grains brings about advantages, such as an increase in covering power and an increase in spectral sensitization efficiency due to sensitizing dyes. These advantages are described in detail in U.S. Pat. No. 4,434,226 cited above. An average aspect ratio of 80% or more of a total projected area of grains is preferably 1 to less than 100, more preferably 2 to less than 30, and most preferably 3 to less than 25. The shape of a tabular grain can be selected from, e.g., a triangle, a hexagon, and a circle. An example of a preferable shape is a regular hexagon having six substantially equal sides, as described in U.S. Pat. No. 4,797,354.

The equivalent-circle diameter of a tabular grain is preferably 0.15 to 5.0 μm. The thickness of a tabular grain is preferably 0.05 to 1.0 μm.

If the value is less than 0.05 μm, the response to pressure is undesirably degraded. A value exceeding 1.0 μm is unpreferable because the merits of the tabular grains cannot be obtained satisfactorily.

Tabular grains with an aspect ratio of 3 or more occupy preferably 50% or more, more preferably 80% or more, and most preferably 90% or more of the total projected area.

It is sometimes possible to obtain more preferable effects by using monodisperse tabular grains. The structure and the method of manufacturing monodisperse tabular grains are described in, e.g., JP-A-63-151618. The shape of the grains will be briefly described below. That is, a hexagonal tabular silver halide, in which the ratio of an edge having the maximum length with respect to the length of an edge having the minimum length is 2 or less, and which has two parallel faces as outer surfaces, accounts for 70% or more of the total projected area of silver halide grains. In addition, the grains have monodispersibility; that is, a variation coefficient of a grain size distribution of these hexagonal tabular silver halide grains (i.e., a value obtained by dividing a variation (standard deviation) in grain sizes, which are represented by equivalent-circle diameters of projected areas of the grains, by their average grain size) is 20% or less.

The use of grains having dislocation lines is preferable.

Dislocation lines of the tabular grain can be observed by using a transmission electron microscope. It is preferable to select a grain containing no dislocations, a grain containing several dislocations, or a grain containing a large number of dislocations in accordance with the intended use. It is also possible to select dislocations introduced linearly with respect to a specific direction of a crystal orientation of a grain or dislocations curved with respect to that direction. Alternatively, it is possible to selectively introduce dislocations throughout an entire grain or only to a particular portion of a grain, e.g., the fringe portion of a grain. Introduction of dislocation lines is preferable not only for tabular grains but for a regular crystal grain or an irregular grain represented by a potato-like grain. Also in this case, it is preferable to limit the positions of dislocation lines to specific portions, such as the corners or the edges, of a grain.

A silver halide emulsion used in the present invention may be subjected to a treatment for rounding grains, as disclosed in EP 96,727B1 or EP 64,412B1, or surface modification, as disclosed in West German Patent 2,306,447C2 or JP-A-60-221320.

Although a flat grain surface is common, intentionally forming projections and recesses on the surface is preferable in some cases. Examples are methods described in JP-A-58-106532 and JP-A-60-221320, in which a hole is formed in a portion of a crystal, e.g., the corner or the center of the face of a crystal, and a ruffle grain described in U.S. Pat. No. 4,643,966.

The grain size of an emulsion used in the present invention can be evaluated in terms of the equivalent-circle diameter of the projected area of a grain obtained by using an electron microscope, the equivalent-sphere diameter of the volume of a grain calculated from the projected area and the thickness of the grain, or the equivalent-sphere diameter of the volume of a grain obtained by a Coulter counter method. It is possible to selectively use various grains from a very fine grain having an equivalent-sphere diameter of 0.05 μm or less to a large grain having that of 10 μm or more. It is preferable to use a grain having an equivalent-sphere diameter of 0.1 to 3 μm as a light-sensitive silver halide grain.

In the present invention, it is possible to use a so-called polydisperse emulsion having a wide grain size distribution or a monodisperse emulsion having a narrow grain size distribution in accordance with the intended use. As a measure representing the size distribution, a variation coefficient of either the equivalent-circle diameter of the projected area of a grain or the equivalent-sphere diameter of volume of a grain is sometimes used. When a monodisperse emulsion is to be used, it is desirable to use an emulsion having a size distribution with a variation coefficient of preferably 25% or less, more preferably 20% or less, and most preferably 15% or less.

The monodisperse emulsion is sometimes defined as an emulsion having a grain size distribution in which 80% or more of all grains fall within a range of ±30% of an average grain size represented by the number or the weight of grains. In order for a light-sensitive material to satisfy its target gradation, two or more monodisperse silver halide emulsions having different grain sizes can be mixed in the same emulsion layer or coated as different layers in an emulsion layer having essentially the same color sensitivity. It is also possible to mix, or coat as different layers, two or more types of polydisperse silver halide emulsions or monodisperse emulsions together with polydisperse emulsions.

Photographic emulsions used in the present invention can be prepared by the methods described in, e.g., P. Glafkides, Chimie et Physique Photographique, Paul Montel, 1967; G. F. Duffin, Photographic Emulsion Chemistry, Focal Press, 1966; and V. L. Zelikman et al., Making and Coating Photographic Emulsion, Focal Press, 1964. That is, any of an acid method, a neutral method, and an ammonia method can be used. In forming grains by a reaction of a soluble silver salt and a soluble halogen salt, any of a single-jet method, a double-jet method, and a combination of these methods can be used. It is also possible to use a method (so-called reverse double-jet method) of forming grains in the presence of excess silver ion. As one type of the double-jet method, a method in which the pAg of a liquid phase for producing a silver halide is maintained constant, i.e., a so-called controlled double-jet method can be used. This method makes it possible to obtain a silver halide emulsion in which a crystal shape is regular and a grain size is nearly uniform.

In some cases, it is preferable to make use of a method of adding silver halide grains already formed by precipitation to a reactor vessel for emulsion preparation, and the methods described in U.S. Pat. Nos. 4,334,012, 4,301,241, and 4,150,994. These silver halide grains can be used as seed crystal and are also effective when supplied as a silver halide for growth. In the latter case, addition of an emulsion with a small grain size is preferable. The total amount of an emulsion can be added at one time, or an emulsion can be separately added a plurality of times or added continuously. In addition, it is sometimes effective to add grains having several different halogen compositions in order to modify the surface.

A method of converting most of or only a part of the halogen composition of a silver halide grain by a halogen conversion process is disclosed in, e.g., U.S. Pat. Nos. 3,477,852 and 4,142,900, EP 273,429 and EP 273,430, and West German Patent 3,819,241. This method is an effective grain formation method. To convert into a silver salt that is more hard to dissolve, it is possible to add a solution or silver halide grains of a soluble halogen. The conversion can be performed at one time, separately a plurality of times, or continuously.

As a grain growth method other than the method of adding a soluble silver salt and a halogen salt at a constant concentration and a constant flow rate, it is preferable to use a grain formation method in which the concentration or the flow rate is changed, such as described in British Patent 1,469,480 and U.S. Pat. Nos. 3,650,757 and 4,242,445. Increasing the concentration or the flow rate can change the amount of a silver halide to be supplied as a linear function, a quadratic function, or a more complex function of the addition time. It is also preferable to decrease the silver halide amount to be supplied if necessary depending on the situation. Furthermore, when a plurality of soluble silver salts of different solution compositions are to be added or a plurality of soluble halogen salts of different solution compositions are to be added, a method of increasing one of the salts while decreasing the other is also effective.

A mixing vessel for reacting solutions of soluble silver salts and soluble halogen salts can be selected from those described in U.S. Pat. Nos. 2,996,287, 3,342,605, 3,415,650, and 3,785,777 and west German Patents 2,556,885 and 2,555,364.

A silver halide solvent is useful for the purpose of accelerating ripening. As an example, it is known to make an excess of halogen ion exist in a reactor vessel in order to accelerate ripening. Another ripening agent can also be used. The total amount of these ripening agents can be mixed in a dispersing medium placed in a reactor vessel before addition of silver and a halide salt or can be introduced to the reactor vessel simultaneously with addition of a halide salt, a silver salt, and a deflocculant. Alternatively, ripening agents can be independently added in the step of adding a halide salt and a silver salt.

Examples of the ripening agent are ammonia, thiocyanate (e.g., potassium rhodanate and ammonium rhodanate), an organic thioether compound (e.g., compounds described in U.S. Pat. Nos. 3,574,628, 3,021,215, 3,057,724, 3,038,805, 4,276,374, 4,297,439, 3,704,130, and 4,782,013 and JP-A-57-104926), a thione compound (e.g., 4-substituted thioureas described in JP-A-53-82408, JP-A-55-77737, and U.S. Pat. No. 4,221,863, and compounds described in JP-A-53-144319), mercapto compounds capable of accelerating growth of silver halide grains, described in JP-A-57-202531, and an amine compound (e.g., JP-A-54-100717).

It is advantageous to use gelatin as a protective colloid for use in preparation of emulsions of the present invention or as a binder for other hydrophilic colloid layers. However, another hydrophilic colloid can also be used in place of gelatin.

Examples of the hydrophilic colloid are protein, such as a gelatin derivative, a graft polymer of gelatin and another high polymer, albumin, and casein; a sugar derivative, such as hydroxyethylcellulose, carboxymethylcellulose, a cellulose derivative such as cellulose sulfates, soda alginate, and a starch derivative; and a variety of synthetic hydrophilic high polymers, such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinyl pyrazole.

Examples of gelatin are lime-processed gelatin, acid-processed gelatin, and enzyme-processed gelatin described in Bull. Soc. Sci. Photo. Japan. No. 16, page 30 (1966). In addition, a hydrolyzed product or an enzyme-decomposed product of gelatin can also be used.

It is preferable to wash an emulsion of the present invention for a desalting purpose to form a newly prepared protective colloid dispersion. Although the temperature of washing can be selected in accordance with the intended use, it is preferably 5° C. to 50° C. Although the pH of washing can also be selected in accordance with the intended use, it is preferably 2 to 10, and more preferably 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

In the preparation of an emulsion of the present invention, it is preferable to make salt of metal ion exist during grain formation, desalting, or chemical sensitization, or before coating in accordance with the intended use. The metal ion salt is preferably added during grain formation in performing doping for grains, and after grain formation and before completion of chemical sensitization in decorating the grain surface or when used as a chemical sensitizer. The doping can be performed for any of an overall grain, only the core, the shell, or the epitaxial portion of a grain, and only a substrate grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroacid salt, 6-coordinated complex salt, or 4-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in a combination of two or more types of them.

The metal compounds are preferably dissolved in an appropriate solvent, such as methanol or acetone, and added in the form of a solution. To stabilize the solution, an aqueous halogenated hydrogen solution (e.g., HCl and HBr) or an alkali halide (e.g., KCl, NaCl, KBr, and NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, and KI) and added in the form of a solution continuously during formation of silver halide grains. Furthermore, a solution of the metal compounds can be prepared independently of a water-soluble salt or an alkali halide and added continuously at a proper timing during grain formation. It is also possible to combine several different addition methods.

It is sometimes useful to perform a method of adding a chalcogen compound during preparation of an emulsion, such as described in U.S. Pat. No. 3,772,031. In addition to S, Se, and Te, cyanate, thiocyanate, selenocyanic acid, carbonate, phosphate, and acetate can be present.

In formation of silver halide grains of the present invention, at least one of sulfur sensitization, selenium sensitization, gold sensitization, palladium sensitization or noble metal sensitization, and reduction sensitization can be performed at any step during the process of manufacturing a silver halide emulsion. The use of two or more different sensitizing methods is preferable. Several different types of emulsions can be prepared by changing the timing at which the chemical sensitization is performed. The emulsion types are classified into: a type in which a chemical sensitization speck is embedded inside a grain, a type in which it is embedded at a shallow position from the surface of a grain, and a type in which it is formed on the surface of a grain. In emulsions of the present invention, the location of a chemical sensitization speck can be selected in accordance with the intended use. It is, however, generally preferable to form at least one type of a chemical sensitization speck near the surface.

One chemical sensitization which can be preferably performed in the present invention is chalcogen sensitization, noble metal sensitization, or a combination of these. The sensitization can be performed by using an active gelation as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferable. In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, i.e., a chlorine, bromine, or iodine atom.

More specifically, the palladium compound is preferably $K_2PdCl_4$, $(NH_4)_2PdCl_6$, $Na_2pdCl_4$, $(NH_4)_2PdCl_4$, $Li_2PdCl_4$, $Na_2PdCl_2$, or $K_2PdBr_4$. It is preferable that the gold compound and the palladium compound be used in combination with thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143.

It is preferable to also perform gold sensitization for emulsions of the present invention. An amount of a gold sensitizer per mole of a silver halide is preferably $1\times10^{-4}$ to $1\times10^{-7}$ mole, and more preferably $1\times10^{-5}$ to $5\times10^{-7}$ mole. A preferable amount of a palladium compound is $1\times10^{-3}$ to $5\times10^{-7}$. A preferable amount of a thiocyan compound or a selenocyan compound is $5\times10^{-2}$ to $1\times10^{-6}$.

An amount of a sulfur sensitizer with respect to silver halide grains of the present invention is preferably $1\times10^{-4}$ to $1\times10^{-7}$ mole, and more preferably $1\times10^{-5}$ to $5\times10^{-7}$ mole per mole of a silver halide.

Selenium sensitization is a preferable sensitizing method for emulsions of the present invention. Known label selenium compounds are used in the selenium sensitization. Practical examples of the selenium compound are colloidal metal selenium, selenoureas (e.g., N,N-dimethylselenourea and N,N-diethylselenourea), selenoketones, and selenoamides. In some cases, it is preferable to perform the selenium sensitization in combination with one or both of the sulfur sensitization and the noble metal sensitization.

Silver halide emulsions of the present invention are preferably subjected to reduction sensitization during grain formation, after grain formation and before or during chemical sensitization, or after chemical sensitization.

The reduction sensitization can be selected from a method of adding reduction sensitizers to a silver halide emulsion, a method called silver ripening in which grains are grown or ripened in a low-pAg environment at pAg 1 to 7, and a method called high-pH ripening in which grains are grown or ripened in a high-pH environment at pH 8 to 11. It is also possible to perform two or more of these methods together.

The method of adding reduction sensitizers is preferable in that the level of reduction sensitization can be finely adjusted.

Known examples of the reduction sensitizer are stannous chloride, ascorbic acid and its derivative, amines and polyamines, a hydrazine derivative, formamidinesulfinic acid, a silane compound, and a borane compound. In the reduction sensitization of the present invention, it is possible to selectively use these known reduction sensitizers or to use two or more types of compounds together. Preferable compounds as the reduction sensitizer are stannous chloride, thiourea dioxide, dimethylamineborane, and ascorbic acid and its derivative. Although an addition amount of the reduction sensitizers must be so selected as to meet the emulsion manufacturing conditions, a preferable amount is $10^{-7}$ to $10^{-3}$ mole per mole of a silver halide.

The reduction sensitizers are dissolved in water or a solvent, such as alcohols, glycols, ketones, esters, or amides, and the resultant solution is added during grain growth. Although adding to a reactor vessel in advance is also preferable, adding at a proper timing during grain growth is more preferable. It is also possible to add the reduction sensitizers to an aqueous solution of a water-soluble silver salt or a water-soluble alkali halide to precipitate silver halide grains by using this aqueous solution. Alternatively, a solution of the reduction sensitizers may be added separately several times or continuously over a long time period with grain growth.

It is preferable to use an oxidizer for silver during the process of manufacturing emulsions of the present invention. The oxidizer for silver means a compound having an effect of converting metal silver into silver ion. A particularly effective compound is the one that converts very fine silver grains, as a byproduct in the process of formation of silver halide grains and chemical sensitization, into silver ion. The silver ion produced may form a silver salt hard to dissolve in water, such as a silver halide, silver sulfide, or silver selenide, or a silver salt easy to dissolve in water, such as silver nitrate. The oxidizer for silver may be either an inorganic or organic substance. Examples of the inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., K2S208, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2.6H_2O)$, permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of the organic oxidizer are quinones such as p-quinone, an organic peroxide such as peracetic acid and perbenzoic acid, and a compound for releasing active halogen (e.g., N-bromosuccinimide, chloramine T, and chloramine B).

Preferable oxidizers of the present invention are ozone, hydrogen peroxide and its adduct, a halogen element, an inorganic oxidizer of thiosulfonate, and an organic oxidizer of quinones. A combination of the reduction sensitization described above and the oxidizer for silver is preferable. In this case, the reduction sensitization may be performed after the oxidizer is used or vice versa, or the reduction sensitization and the use of the oxidizer may be performed at the same time. These methods can be selectively performed during grain formation or chemical sensitization.

Photographic emulsions used in the present invention may contain various compounds in order to prevent fog during the manufacturing process, storage, or photographic treatments of a light-sensitive material, or to stabilize photographic properties. Usable compounds are those known as an antifoggant or a stabilizer, for example, thiazoles, such as benzothiazolium salt, nitroimidazoles, nitrobenzimidazoles, chlorobenzimidazoles, bromobenzimidazoles, mercaptothiazoles, mercaptobenzothiazoles, mecaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; azaindenes, such as triazaindenes, tetrazaindenes (particularly hydroxysubstituted( 1,3,3a,7)tetrazaindenes), and pentazaindenes. For example, compounds described in U.S. Pat. Nos. 3,954,474 and 3,982,947 and JP-B-52-28660 can be used. One preferable compound is described in JP-A-63-212932. Antifoggants and stabilizers can be added at any of several different times, such as before, during, and after grain formation, during washing with water, during dispersion after the washing, before, during, and after chemical sensitization, and before coating, in accordance with the intended application. The antifoggants and the stabilizers can be added during preparation of an emulsion to achieve their original fog preventing effect and stabilizing effect. In addition, the antifoggants and the stabilizers can be used for various purposes of, e.g., controlling crystal habit of grains, decreasing a grain size, decreasing the solubility of grains, controlling chemical sensitization, and controlling an arrangement of dyes.

Photographic emulsions used in the present invention are preferably subjected to spectral sensitization by methine dyes and the like in order to achieve the effects of the present invention. Usable dyes involve a cyanine dye, a merocyanine dye, a composite cyanine dye, a composite merocyanine dye, a holopolar cyanine dye, a hemicyanine dye, a styryl dye, and a hemioxonole dye. Most useful dyes are those belonging to a cyanine dye, a merocyanine dye, and a composite merocyanine dye. Any nucleus commonly used as a basic heterocyclic nucleus in cyanine dyes can be applied to these dyes. Examples of an applicable nucleus are a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus, and a pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, a benzindolenine nucleus, an indole nucleus, a benzoxadole nucleus, a naphthoxazole nucleus, a benzthiazole nucleus, a naphthothiazole nucleus, a benzoselenazole nucleus, a benzimidazole nucleus, and a quinoline nucleus. These nuclei may be substituted on a carbon atom.

It is possible to apply to a merocyanine dye or a composite merocyanine dye a 5- to 6-membered heterocyclic nucleus as a nucleus having a ketomethylene structure. Examples are a pyrazoline-5-one nucleus, a thiohydantoin nucleus, a 2-thiooxazolidine-2,4-dione nucleus, a thiazolidine-2,4-dione nucleus, a rhodanine nucleus, and a thiobarbituric acid nucleus.

Although these sensitizing dyes may be used singly, they can also be used together. The combination of sensitizing dyes is often used for a supersensitization purpose. Representative examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patents 1,344,281 and 1,507,803, JP-B-43-4936, JP-B-53-12375, JP-A-52-110618, and JP-A-52-109925.

Emulsions may contain, in addition to the sensitizing dyes, dyes having no spectral sensitizing effect or substances not essentially absorbing visible light and presenting supersensitization.

The sensitizing dyes can be added to an emulsion at any point in preparation of an emulsion, which is conventionally known to be useful. Most ordinarily, the addition is performed after completion of chemical sensitization and before coating. However, it is possible to perform the addition at the same timing as addition of chemical sensitizing dyes to perform spectral sensitization and chemical sensitization simultaneously, as described in U.S. Pat. Nos. 3,628,969 and 4,225,666. It is also possible to perform the addition prior to chemical sensitization, as described in JP-A-58-113928, or before completion of formation of a silver halide grain precipitation to start spectral sensitization. Alternatively, as disclosed in U.S. Pat. No. 4,225,666, these compounds can be added separately; a portion of the compounds may be added prior to chemical sensitization, while the remaining portion is added after that. That is, the compounds can be added at any timing during formation of silver halide grains, including the method disclosed in U.S. Pat. No. 4,183,756.

The addition amount may be $4\times10^{-6}$ to $8\times10^{-3}$ mole per mole of a silver halide. However, for a more preferable silver halide grain size of 0.2 to 1.2 μm, an addition amount of about $5\times10^{-5}$ to $2\times10^{-3}$ mole is more effective.

The light-sensitive material of the present invention needs only to have at least one of silver halide emulsion layers, i.e., a blue-sensitive layer, a green-sensitive layer, and a red-sensitive layer, formed on a support. The number or order of the silver halide emulsion layers and the non-light-sensitive layers are particularly not limited. A typical example is a silver halide photographic light-sensitive material having, on a support, at least one unit light-sensitive layer constituted by a plurality of silver halide emulsion layers which are sensitive to essentially the same color but have different sensitivities or speeds. The unit light-sensitive layer is sensitive to blue, green or red light. In a multi-layered silver halide color photographic light-sensitive material, the unit light-sensitive layers are generally arranged such that red-, green-, and blue-sensitive layers are formed from a support side in the order named. However, this order may be reversed or a layer having a different color sensitivity may be sandwiched between layers having the same color sensitivity in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-speed emulsion layers can be preferably used as described in west German Patent 1,121,470 or British Patent 923,045. In this case, layers are preferably arranged such that the sensitivity or speed is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-speed emulsion layer is formed remotely from a support and a high-speed layer is formed close to the support.

More specifically, layers may be arranged from the farthest side from a support in an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-B-56-25738 and JP-B-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an intermediate layer, and a silver halide emulsion layer having sensitivity lower than that of the intermediate layer is arranged as a lower layer. In other words, three layers having different sensitivities may be arranged such that the sensitivity is sequentially decreased toward the support. When a layer structure is constituted by three layers having different sensitivities or speeds, these layers may be arranged in an order of medium-speed emulsion layer/high-speed emulsion layer/low-speed emulsion layer from the farthest side from a support in a layer having the same color sensitivity as described in JP-A-59-202464.

Also, an order of high-speed emulsion layer/low-speed emulsion layer/medium-speed emulsion layer, or low-speed emulsion layer/medium-speed emulsion layer/high-speed emulsion layer may be adopted. Furthermore, the arrangement can be changed as described above even when four or more layers are formed.

As described above, various layer configurations and arrangements can be selected in accordance with the application of the light-sensitive material.

Although various additives described above can be used in the present invention, other various additives also can be used in accordance with the purposes.

More specifically, these additives are described in Research Disclosures Item 17643 (December 1978), Item 18716 (November 1979) and Item 308119 (December 89), and they are summarized in the following Table:

| Additives | RD17643 | RD18716 | RD308119 |
|---|---|---|---|
| 1. Chemical sensitizers | page 23 | page 648, right column | page 996 |
| 2. Sensitivity-increasing agents | | page 648, right column | |
| 3. Spectral sensitizers, super-sensitizers | pp. 23–24 | page 648, right column to page 649, right column | pp. 996, right-998, right |
| 4. Brighteners | page 24 | page 648, right column | page 998, right |
| 5. Antifoggants, stabilizers | pp. 24–25 | page 649, right column | pp. 998, right-1000, right |
| 6. Light absorbent, filter dye, ultra-violet absorbents | pp. 25–26 | page 649, right column to page 650, left column | pp. 1003, left-1003, right |
| 7. Stain-preventing agents | page 25, right column | page 650, left-right columns | page 1002, right |
| 8. Dye image-stabilizer | page 25 | page 650, left column | page 1002, right |
| 9. Hardening agents | page 26 | page 651, left column | pp. 1004, right-1005, left |
| 10. Binder | page 26 | page 651, left column | pp. 1003, right-1004, right |
| 11. Plasticizers, lubricants | page 27 | page 650, right column | pp. 1006, left-1006, right |
| 12. Coating aids, surface active agents | pp. 26-27 | page 650, right column | pp. 1005, left-1006, left |
| 13. Antistatic agents | page 27 | page 650, right column | pp. 1006, right-1007, left |
| 14. Matting agent | | | pp. 1008, left-1009, left |

In order to prevent degradation in photographic properties caused by formaldehyde gas, a compound described in U.S. Pat. No. 4,411,987 or 4,435,503, which can react with formaldehyde and fix the same, is preferably added to the light-sensitive material.

various color couplers can be used in the present invention, and specific examples of these couplers are described in patents described in the above-mentioned RD No. 17643, VII-C to VII-G and RD No. 307105, VII-C to VII-G.

Preferable examples of yellow couplers are described in, e.g., U.S. Pat. Nos. 3,933,501; 4,022,620; 4,326,024; 4,401,752 and 4,248,961, JP-B-58-10739, British Patents 1,425,020 and 1,476,760, U.S. Pat. Nos. 3,973,968; 4,314,023 and 4,511,649, and European Patent 249,473A.

Examples of a magenta coupler are preferably 5-pyrazolone type and pyrazoloazole type compounds, and more preferably, compounds described in, for example, U.S. Pat. Nos. 4,310,619 and 4,351,897, European Patent 73,636, U.S. Pat. Nos. 3,061,432 and 3,725,067, RD No. 24220 (June 1984), JP-A-60-33552, RD No. 24230 (June 1984), JP-A-60-43659, JP-A-61-72238, JP-A-60-35730, JP-A-55-118034, JP-A-60-185951, U.S. Pat. Nos. 4,500,630; 4,540,654 and 4,556,630, and WO No. 88/04795.

Examples of a cyan coupler are phenol type and naphthol type ones. Of these, preferable are those described in, for example, U.S. Pat. Nos. 4,052,212; 4,146,396; 4,228,233; 4,296,200; 2,369,929; 2,801,171; 2,772,162; 2,895,826; 3,772,002; 3,758,308; 4,343,011 and 4,327,173, West German Patent Laid-open Application 3,329,729, European Patents 121,365A and 249,453A, U.S. Pat. Nos. 3,446,622; 4,333,999; 4,775,616; 4,451,559; 4,427,767; 4,690,889; 4,254,212 and 4,296,199, and JP-A-61-42658.

Typical examples of a polymerized dye-forming coupler are described in, e.g., U.S. Pat. Nos. 3,451,820; 4,080,211; 4,367,282; 4,409,320 and 4,576,910, British Patent 2,102,173, and European Patent 341,188A.

Preferable examples of a coupler capable of forming colored dyes having proper diffusibility are those described in U.S. Pat. No. 4,366,237, British Patent 2,125,570, European Patent 96,570, and West German Laid-open Patent Application No. 3,234,533.

Preferable examples of a colored coupler for correcting unnecessary absorption of a colored dye are those described in RD No. 17643, VII-G, RD No. 30715, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Those compounds which release a photographically useful residue upon coupling may also be preferably used in the present invention. DIR couplers, i.e., couplers releasing a development inhibitor, are preferably those described in the patents cited in the above-described RD No. 17643, VII-F and RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Preferable examples of a coupler which imagewise releases a nucleating agent or a development accelerator are preferably those described in British Patents 2,097,140 and 2,131,188, JP-A-59-157638, and JP-A-59-170840. In addition, compounds releasing, e.g., a fogging agent, a development accelerator, or a silver halide solvent upon redox reaction with an oxidized form of a developing agent, described in JP-A-60-107029, JP-A-60-252340, JP-A-1-44940, and JP-A-1-45687, can also be preferably used.

Examples of other compounds which can be used in the light-sensitive material of the present invention are competing couplers described in, for example, U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, for example, JP-A-60-185950 and JP-A-62-24252; couplers releasing a dye which restores color after being released described in European Patent 173,302A and 313,308A; a legend releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

The couplers for use in this invention can be introduced into the light-sensitive material by various known dispersion methods.

Examples of a high-boiling point organic solvent to be used in the oil-in-water dispersion method are described in, e.g., U.S. Pat. No. 2,322,027.

Examples of a high-boiling point organic solvent to be used in the oil-in-water dispersion method and having a boiling point of 175° C. or more at atmospheric pressure are phthalic esters (e.g., dibutylphthalate, dicyclohexylphthalate, di-2-ethylhexylphthalate, decylphthalate, bis(2,4-di-t-amylphenyl) phthalate, bis(2,4-di-t-amylphenyl) isophthalate, bis(1,1-di-ethylpropyl) phthalate), phosphate or phosphonate esters (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoate esters (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearyl alcohol and 2,4-di-tert-amylphenol), aliphatic carboxylate esters (e.g., bis(2-ethylhexyl) sebacate, dioctylazelate, glyceroltributyrate, isostearyllactate, and trioctylcitrate), an aniline derivative (e.g., N,N-dibutyl-2-butoxy-5-tert-octylaniline), and hydrocarbons (e.g., paraffin, dodecylbenzene, and diisopropylnaphthalene). An organic solvent having a boiling point of about 30° C. or more, and preferably, 50° C. to about 160° C. can be used as an auxiliary solvent. Typical examples of the auxiliary solvent are ethyl acetate, butyl acetate, ethyl propionate, methylethylketone, cyclohexanone, 2-ethoxyethylacetate, and dimethylformamide.

Steps and effects of a latex dispersion method and examples of a immersing latex are described in, e.g., U.S. Pat. No. 4,199,363 and German Laid-open Patent Application (OLS) Nos. 2,541,274 and 2,541,230.

Various types of antiseptics and fungicides agent are preferably added to the color light-sensitive material of the present invention. Typical examples of the antiseptics and the fungicides are phenethyl alcohol, and 1,2-benzisothiazolin-3-one, n-butyl p-hydroxybenzoate, phenol, 4-chloro-3,5-dimethylphenol, 2-phenoxyethanol, and 2-(4-thiazolyl-)benzimidazole, which are described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, a color paper, a color positive film, and a color reversal paper.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the sum total of film thicknesses of all hydrophilic colloidal layers at the side having emulsion layers is preferably 28 μm or less, more preferably, 23 μm or less, much more preferably, 18 μm or less, and most preferably, 16 μm or less. A film swell speed $T_{1/2}$ is preferably 30 seconds or less, and more preferably, 20 seconds or less. The film thickness means a film thickness measured under moisture conditioning at a temperature of 25° C. and a relative humidity of 55% (two days). The film swell speed $T_{1/2}$ can be measured in accordance with a known method in the art. For example, the film swell speed $T_{1/2}$ can be measured by using a swellometer described by A. Green et al. in Photographic Science & Engineering, Vol. 19, No. 2, pp. 124 to 129. When 90% of a maximum swell film thickness reached by performing a treatment by using a color developer at 30° C. for 3 minutes and 15 seconds is defined as a saturated film thickness, $T_{1/2}$ is defined as a time required for reaching ½ of the saturated film thickness.

The film swell speed $T_{1/2}$ can be adjusted by adding a film hardening agent to gelatin as a binder or changing aging conditions after coating.

In the light-sensitive material of the present invention, a hydrophilic colloid layer (called back layer) having a total dried film thickness of 2 to 20 μm is preferably formed on the side opposite to the side having emulsion layers. The back layer preferably contains, e.g., the light absorbent, the filter dye, the ultraviolet absorbent, the antistatic agent, the film hardener, the binder, the plasticizer, the lubricant, the coating aid, and the surfactant, described above. The swell ratio of the back layer is preferably 150% to 500%.

The color photographic light-sensitive material according to the present invention can be developed by conventional methods described in RD. No. 17643, pp. 28 and 29, RD. No. 18716, the left to right columns, page 651, and RD. No. 307105, pp. 880 and 881.

A color developer used in development of the light-sensitive material of the present invention is an aqueous alkaline solution containing as a main component, preferably, an aromatic primary amine color developing agent. As the color developing agent, although an aminophenol compound is effective, a p-phenylenediamine compound is preferably used. Typical examples of the p-phenylenediamine compound are: 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and the sulfates, hydrochlorides and p-toluenesulfonates thereof. Of these compounds, 3-methyl-4-amino-N-ethyl-N-β-hydroxyethylaniline sulfate is preferred in particular. The above compounds can be used in a combination of two or more thereof in accordance with the application.

In general, the color developer contains a pH buffering agent such as a carbonate, a borate or a phosphate of an alkali metal, and a development restrainer or an antifoggant such as a chloride, a bromide, an iodide, a benzimidazole, a benzothiazole, or a mercapto compound. If necessary, the color developer may also contain a preservative such as hydroxylamine, diethylhydroxylamine, a sulfite, a hydrazine such as N,N-biscarboxymethyl-hydrazine, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye-forming coupler; a competing coupler; an auxiliary developing agent such as 1-phenyl-3-pyrazolidone; a viscosity-imparting agent; and a chelating agent such as an aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, and ethylenediamine-di(o-hydroxyphenylacetic acid), and salts thereof.

In order to perform reversal development, black-and-white development is performed and then color development is performed. As a black-and-white developer, a well-known black-and-white developing agent, e.g., a dihydroxybenzene such as hydroquinone, a 3-pyrazolidone such as 1-phenyl-3-pyrazolidone, and an aminophenol such as N-methyl-p-aminophenol can be used singly or in a combination of two or more thereof. The pH of the color and black-and-white developers is generally 9 to 12. Although the quantity of replenisher of the developers depends on a color photographic light-sensitive material to be processed, it is generally 3 liters or less per $m^2$ of the light-sensitive material. The quantity of replenisher can be decreased to be 500 ml or less by decreasing a bromide ion concentration in a replenisher. When the quantity of the replenisher is decreased, a contact area of a processing tank with air is preferably decreased to prevent evaporation and oxidation of the solution upon contact with air.

The contact area of the processing solution with air in a processing tank can be represented by an aperture defined below:

Aperture=[contact area ($cm^2$) of processing solution with air]/[volume ($cm^3$) of the solution]

The above aperture is preferably 0.1 or less, and more preferably, 0.001 to 0.05. In order to reduce the aperture, a shielding member such as a floating cover may be provided on the surface of the photographic processing solution in the processing tank. In addition, a method of using a movable cover described in JP-A-1-82033 or a slit developing method descried in JP-A-63-216050 may be used. The aperture is preferably reduced not only in color and black-and-white development steps but also in all subsequent steps, e.g., bleaching, bleach-fixing, fixing, washing, and stabilizing steps. In addition, the quantity of replenisher can be reduced by using a means of suppressing storage of bromide ions in the developing solution.

A color development time is normally 2 to 5 minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are compounds of a polyvalent metal, e.g., iron (III); peracids; quinones; and nitro compounds. Typical examples of the bleaching agent are an organic complex salt of iron (III), e.g., a complex salt with an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid; or a complex salt with citric acid, tartaric acid, or malic acid. Of these compounds, an iron (III) complex salt of an aminopolycarboxylic acid such as an iron (III) complex salt of ethylenediaminetetraacetic acid or 1,3-diaminopropanetetraacetic acid is preferred because it can increase a processing speed and prevent an environmental contamination. The iron (III) complex salt of an aminopolycarboxylic acid is useful in both the bleaching and bleach-fixing solutions. The pH of the bleaching or bleach-fixing solution using the iron (III) complex salt of an aminopolycarboxylic acid is normally 4.0 to 8. In order to increase the processing speed, however, processing can be performed at a lower pH.

A bleaching accelerator can be used in the bleaching solution, the bleach-fixing solution, and their prebath, if necessary. Examples of a useful bleaching accelerator are: compounds having a mercapto group or a disulfide group described in, for example, U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and RD No. 17129 (July, 1978); thiazolidine derivatives described in JP-A-50-140129; thiourea derivatives described in JP-B-45-8506, JP-A-52-20832, JP-A-53-32735, and U.S. Pat. No. 3,706,561; iodide salts described in West German Patent 1,127,715 and JP-A-58-16235; polyoxyethylene compounds descried in West German Patents 966,410 and 2,748,430; polyamine compounds described in JP-B-45-8836; compounds descried in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, e.g., acetic acid, propionic acid, or hydroxy acetic acid.

Examples of the fixing agent used in the fixing solution or the bleach-fixing solution are a thiosulfate salt, a thiocyanate salt, a thioether-based compound, a thiourea and a large amount of an iodide. Of these compounds, a thiosulfate, especially, ammonium thiosulfate, can be used in the widest range of applications. In addition, a combination of a thiosulfate with a thiocyanate, a thioether-based compound or thiourea is preferably used. As a preservative of the fixing solution or the bleach-fixing solution, a sulfite, a bisulfite, a carbonyl bisulfite adduct, or a sulfinic acid compound described in European Patent 294,769A is preferred. Further, in order to stabilize the fixing solution or the bleach-fixing solution, various types of aminopolycarboxylic acids or organic phosphonic acids are preferably added to the solution.

In the present invention, 0.1 to 10 moles, per liter, of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no desilvering defect occurs. A preferable time is one to three minutes, and more preferably, one to two minutes. A processing temperature is 25° C. to 50° C., and preferably, 35° C. to 45° C. Within the preferable temperature range, a desilvering speed is increased, and generation of a stain after the processing can be effectively prevented.

In the desilvering step, stirring is preferably as strong as possible. Examples of a method of intensifying the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyer means described in JP-A-60-191257, JP-A-60-191258, or JP-A-60-191259. As described in JP-A-60-191257, this conveyer means can significantly reduce carry-over of a processing solution from a pre-bath to a post-bath, thereby effectively preventing degradation in performance of the processing solution. This effect significantly shortens especially a processing time in each processing step and reduces the quantity of replenisher of a processing solution.

The photographic light-sensitive material of the present invention is normally subjected to washing and/or stabilizing steps after desilvering. An amount of water used in the washing step can be arbitrarily determined over a broad range in accordance with the properties (e.g., a property determined by the substances used, such as a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, PP. 248–253 (May, 1955).

In the multi-stage counter-current scheme disclosed in this reference, the amount of water used for washing can be greatly decreased. Since washing water stays in the tanks for a long period of time, however, bacteria multiply and floating substances may be adversely attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and a cyabendazole described in JP-A-57-8542, a chlorine-based germicide such as chlorinated sodium isocyanurate, and germicides such as benzotriazole, described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bobai Gakkai ed., "Dictionary of Antibacterial and Antifungal Agents", (1986), can be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of water-washing. All known methods described in JP-A-57-8543, JP-A-58-14834, and JP-A-60-220345 can be used in such stabilizing processing.

In some cases, stabilizing is performed subsequently to washing. An example is a stabilizing bath containing a dye stabilizing agent and a surface-active agent to be used as a final bath of the photographic color light-sensitive material. Examples of the dye stabilizing agent are an aldehyde such as formalin or glutaraldehyde, an N-methylol compound, hexamethylenetetramine, and an adduct of aldehyde sulfite. Various chelating agents and fungicides can be added to the stabilizing bath.

An overflow solution produced upon washing and/or replenishment of the stabilizing solution can be reused in another step such as a desilvering step.

In the processing using an automatic developing machine or the like, if each processing solution described above is concentrated by evaporation, water is preferably added to correct the concentration.

The silver halide color light-sensitive material of the present invention may contain a color developing agent in order to simplify processing and increases a processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and RD Nos. 14850 and 15159, an aldol compound described in RD No. 13924, a metal salt complex described in U.S. Pat. No. 3,719,492, and a urethane-based compound described in JP-A-53-135628.

The silver halide color light-sensitive material of the present invention may contain various 1-phenyl-3pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

Further, the silver halide light-sensitive material of the present invention can be applied also to a heat-developing light-sensitive material as disclosed in, e.g., U.S. Pat. No. 4,500,626, JP-A-60-133449, JP-A-59-218443, JP-A-61-238056, and European Patent 210,660A2.

The silver halide color light-sensitive material of the present invention exerts its advantages more effectively when applied to a film unit equipped with a lens disclosed in JP-B-2-32615 or Examined Published Japanese Utility Model Application (JU-B) 3-39784.

The present invention will be described in greater detail below by way of its examples, but the invention is not limited to these examples.

EXAMPLE 1

Tabular Silver Bromoiodide Emulsion (1) Preparation of Emulsions

Tabular silver bromide core emulsion 1-A

While 1,200 cc of an aqueous solution containing 6.2 g of gelatin and 6.4 g of KBr were stirred at 60° C., 8 cc of an aqueous 1.9M $AgNO_3$ solution and 9.6 cc of an aqueous 1.7M KBr solution were added to the solution over 45 seconds by a double-jet method. After 38 g of gelatin were added to the resultant solution, the temperature was raised to 75° C., and the solution was ripened in the presence of $NH_3$ for 20 minutes. After being neutralized with $HNO_3$, the resultant solution was added with 405 cc of an aqueous 1.9M $AgNO_3$ solution and an aqueous KBr solution over 87 minutes with the pAg kept at 8.22 while the flow rate was accelerated (such that the final flow rate was 10 times that at the beginning). Thereafter, the resultant emulsion was cooled to 35° C. and desalted by a conventional flocculation method. The obtained silver bromide emulsion consisted of tabular grains with an average diameter as circle of 2.0 μm, an average thickness of 0.25 μm, and an average aspect ratio of 8.

Tabular silver bromoiodide emulsion 1-B (Comparative emulsion)

The emulsion 1-A containing silver bromide corresponding to 164 g as an amount of $AgNO_3$ was added to 1,950 cc of water, and the temperature, the pAg, and the pH of the resultant solution were kept at 55° C., 8.9, and 5.0, respectively. Thereafter, 126 cc of an aqueous 0.32M KI solution were added to the solution at a constant flow rate over five minutes. Subsequently, 206 cc of an aqueous 1.9M $AgNO_3$ solution and an aqueous KBr solution were added to the resultant solution over 36 minutes with the pAg kept at 8.9. The resultant emulsion was then desalted by the conventional flocculation method. The obtained silver bromoiodide emulsion consisted of tabular grains with an average diameter as circle of 2.1 μm, an average thickness of 0.30 μm, and an average aspect ratio of 7. In this emulsion, tabular grains with an aspect ratio of 4 or more occupied 80% or more of the total projected area of grains. This was the same with tabular emulsions 1-C to 1-H below.

Tabular silver bromoiodide emulsion 1-C (Comparative emulsion)

An emulsion 1-C was prepared following the same procedures as for the emulsion 1-B except the following.

Instead of the addition of the aqueous KI solution, a silver iodide fine grain emulsion corresponding to 6.8 g of $AgNO_3$ and having an average grain size of 0.02 μm, which was separately prepared in advance, was added and completely dissolved over 10 minutes.

Tabular silver bromoiodide emulsion 1-D (Comparative emulsion)

An emulsion 1-D was prepared following the same procedures as for the emulsion 1-B except the following.

Instead of the addition of the aqueous KI solution, an aqueous iodoacetic acid (7.5 g) solution was added. Then an aqueous NaOH solution was added, and the pH was raised to 10.5 and kept at the value for 15 minutes to generate iodide ions gradually. Thereafter, the pH was returned to 5.0. A time required for 50% of the added iodoacetic acid to complete release of iodide ions was 30 minutes or more (measured from the moment the pH was raised to 10.5). Note that the iodide ion-releasing rate was calculated as follows. That is, emulsion grains were separated by centrifugal separation, and the amount of an unreacted iodide ion-releasing agent contained in the supernatant liquid was determined by an ICP (Inductively Coupled Plasma) analysis method. The iodide ion-releasing rate was obtained from the change in this amount with time. This is the same with the following emulsions.

Tabular silver bromoiodide emulsion 1-E (Emulsion of the present invention)

An emulsion 1-E was prepared following the same procedures as for the emulsion 1-B except the following.

Instead of the addition of the aqueous KI solution, 2-iodoethanol (3.1 cc) was added. Then an aqueous NaOH solution was added, and the pH was raised to 10.5 and kept at the value for four minutes to generate iodide ions rapidly. Thereafter, the pH was returned to 5.0. A time required for 50% of the added 2-iodoethanol to complete release of iodide ions was 30 seconds (measured from the moment the pH was raised to 10.5). Tabular silver bromoiodide emulsion 1-F (Emulsion of the present invention)

An emulsion 1-F was prepared following the same procedures as for the emulsion 1-B except the following.

Instead of the addition of the aqueous KI solution, an aqueous 2-iodoacetamide (7.4 g) solution was added. Thereafter, an aqueous 0.80M sodium sulfite solution (75 cc) and then an aqueous NaOH solution were added, the pH was raised to 9.0 and kept at the value for eight minutes to generate iodide ions rapidly. Thereafter, the pH was returned to 5.0. A time required for 50% of the added 2-iodoacetamide to complete release of iodide ions was 10 seconds (measured from the moment the pH was raised to 9.0).

Tabular silver bromoiodide emulsion 1-G (Emulsion of the present invention)

An emulsion 1-G was prepared following the same procedures as for the emulsion 1-B except the following.

Instead of the addition of the aqueous KI solution, an aqueous sodium p-iodoacetamidobenzenesulfonate (15.3 g) solution was added. Thereafter, an aqueous 0.80M sodium sulfite solution (60 cc) and then an aqueous NaOH solution were added, and the pH was raised to 9.0 and kept at the value for eight minutes to generate iodide ions rapidly. Thereafter, the pH was returned to 5.0. A time required for 50% of the added sodium p-iodoacetamidobenzenesulfonate to complete release of iodide ions was 10 seconds (measured from the moment the pH was raised to 9.0).

Tabular silver bromolodide emulsion 1-H (Emulsion of the present invention)

An emulsion 1-H was prepared following the same procedures as for the emulsion 1-B except the following.

Instead of the addition of the aqueous KI solution, an aqueous sodium N-iodoacetylaminoethanesulfonate (12.6 g) solution was added. Thereafter, an aqueous 0.80M sodium sulfite solution (100 cc) and then an aqueous NaOH solution were added, the pH was raised to 9.5 and kept at the value for eight minutes to generate iodide ions rapidly. Thereafter, the pH was returned to 5.0. A time required for 50% of the added sodium N-iodoacetylaminoethanesulfonate to complete release of iodide ions was 10 seconds (measured from the moment the pH was raised to 9.5).

Tabular silver bromide core emulsion 2-A

An emulsion 2-A was prepared following the same procedures as for the emulsion 1-A except the following.

The temperature was kept at 30° C. instead of 60° C., and 48 cc of an aqueous 0.1M $AgNO_3$ solution and 25 cc of an aqueous 0.2M KBr solution were added over 10 seconds instead of the addition of 8 cc of the aqueous 1.9M $AgNO_3$ solution and 9.6 cc of the aqueous 1.7M KBr solution over 45 seconds. In addition, instead of the ripening in the presence of $NH_3$, physical ripening was performed in the absence of $NH_3$ for 20 minutes. The obtained silver bromide emulsion comprises tabular grains with an average diameter as circle of 2.6 μm, an average thickness of 0.14 μm, and an average aspect ratio of 19.

Tabular silver bromoiodide emulsion 2-B (Comparative emulsion)

An emulsion 2-B was prepared following the same procedures as for the emulsion 1-B except the following.

The core emulsion 2-A was used in place of the core emulsion 1-A. The obtained silver bromoiodide emulsion comprises tabular grains with an average diameter as circle of 2.7 μm, an average thickness of 0.18 μm, and an average aspect ratio of 15. In this emulsion, grains with an aspect ratio of 10 or more occupied 90% of more of the total projected area. This was the same with a tabular emulsion 2-C below.

Tabular silver bromoiodide emulsion 2-C (Emulsion of the present invention)

An emulsion 2-C was prepared following the same procedures as for the emulsion 1-G except the following.

The core emulsion 2-A was used in place of the core emulsion 1-A.

(2) Chemical Sensitization

Gold-sulfur sensitization was performed for the emulsions 1-B to 1-H, 2-B, and 2-C as follows.

Each emulsion was heated up to 64° C. and added with $2.6\times10^{-4}$ mol/molAg, $1.1\times10^{-5}$ mol/molAg, and $3.6\times10^{-4}$ mol/molAg of sensitizing dyes ExS-1, ExS-2, and ExS-3, described in Example 2 to be presented later. Thereafter, chemical sensitization was optimally performed for each emulsion by adding potassium thiocyanate, chloroauric acid, and sodium thiosulfate.

"Chemical sensitization was optimally performed" means chemical sensitization by which the highest sensitivity is obtained when exposure is performed for 1/100 second.

(3) Making and Evaluation of Coated Samples

The emulsion layer listed in Table 1 and protective layer were coated in amounts listed in Table A on cellulose triacetate film supports having subbing layers, thereby making coated samples.

TABLE A

| Emulsion coating conditions | |
|---|---|
| (i) Emulsion layer | |
| Emulsion | several different emulsions (silver $3.6\times10^{-2}$ mole/m$^2$) |
| Coupler | ($1.5\times10^{-3}$ mole/m$^2$) |

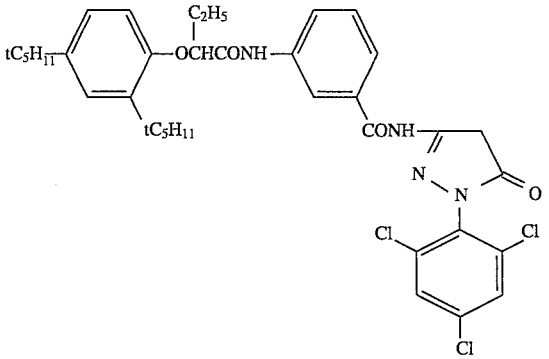

TABLE A-continued

| Emulsion coating conditions | |
|---|---|
| Tricresylphosphate | (1.10 g/m$^2$) |
| Gelatin | (2.30 g/m$^2$) |
| (ii) Protective layer | |
| 2,4-dichloro-6-hydroxy-s-triazine sodium salt | (0.08 g/m$^2$) |
| Gelatin | (1.80 g/m$^2$) |

These samples were left to stand at a temperature of 40° C. and a relative humidity of 70% for 14 hours, exposed through a continuous wedge for 1/100 second, and subjected to color development shown in Table B below.

The densities of the samples thus processed were measured through a green filter.

TABLE B

| Process | Time | Temperature |
|---|---|---|
| Color development | 2 min. 00 sec. | 40° C. |
| Bleach-fixing | 3 min. 00 sec. | 40° C. |
| Washing (1) | 20 sec. | 35° C. |
| Washing (2) | 20 sec. | 35° C. |
| Stabilization | 20 sec. | 35° C. |
| Drying | 50 sec. | 65° C. |

The compositions of the individual processing solutions are given below.

| | (g) |
|---|---|
| (Color developing solution) | |
| Diethylenetriaminepentaacetate | 2.0 |
| 1-hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-ethyl-N-β-hydroxylethylamino)-2-methylaniline sulfate | 4.5 |
| Water to make | 1.0 l |
| pH | 10.05 |
| (Bleach-fixing solution) | |
| Ferric ammonium ethylenediamine-tetraacetate dihydrate | 90.0 |
| Disodium ethylenediaminetetraacetate | 5.0 |
| Sodium sulfite | 12.0 |
| Ammonium thiosulfate aqueous solution (70%) | 260.0 ml |
| Acetic acid (98%) | 5.0 ml |
| Bleaching accelerator | 0.01 mole |

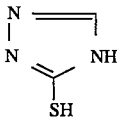

-continued

| | (g) |
|---|---|
| Water to make | 1.0 l |
| pH | 6.0 |

(Washing Solution)

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/l or less. Subsequently, 20mg/l of sodium isocyanuric acid dichloride and 1.5 g/l of sodium sulfate were added.

The pH of the solution ranged from 6.5 to 7.5.

| (Stabilizing solution) | (g) |
|---|---|
| Formalin (37%) | 2.0 ml |
| Polyoxyethylene-p-monononylphenylether (average polymerization degree = 10) | 0.3 |
| Disodium ethylenediaminetetraacetate | 0.05 |
| Water to make | 1.0 l |
| pH | 5.0–8.0 |

The sensitivity is represented by a relative value of the logarithm of the reciprocal of an exposure amount (lux·sec) at which a density of fog+0.2 is given.

The response to pressure was obtained by the following test method A. Thereafter, sensitometry exposure was given to each sample, and the color development shown in Table B was performed.

Test Method A

Each sample was left to stand in an atmosphere at a relative humidity of 55% for three hours or more and, in the same atmosphere, applied with a load of 4 g by using a needle 0.1 mm in diameter. In this condition, the emulsion surface was scratched at a rate of 1 cm/sec.

The density of each developed sample was measured for each of a portion applied with the pressure and a portion not applied with the pressure by using a 5 μm×1 mm measurement slit.

Assume that an increase in fog caused by the pressure is ΔFog. Assume also that in an exposure region where exposure is less than 100 times an exposure amount $E_0$ by which a density of fog+0.2 is given, if the density is decreased 0.01 or more by the pressure between given exposure amounts $E_1$ and $E_2$, the following relation is given:

$$\text{pressure desensitization region} = ((\log E_2 - \log E_1)/2) \times 100\ (\%)$$

The obtained results are summarized in Table 1 below.

TABLE 1

| Sample No. | Emulsion | Iodide ion-releasing agent | Ratio of tabular grains having 30 or more of dislocation lines, per grain, in essentially only the fringe (fringe-dislocation tabular grains) | Ratio of tabular grains having not more than 30 of dislocation lines and major face-dislocation tabular grains |
|---|---|---|---|---|
| 1 | 1-B | KI | 25% | 75% |
| 2 | 1-C | AgI fine grains (0.02 μm) | 60% | 40% |
| 3 | 1-D | $ICH_2COOH$ | 5% | 95% |
| 4 | 1-E | $ICH_2CH_2OH$ | 90.5% | 9.5% |
| 5 | 1-F | $ICH_2CONH_2$ | 92.5% | 7.5% |
| 6 | 1-G | 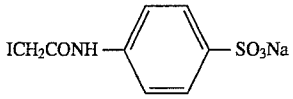 | 93% | 7% |
| 7 | 1-H | $ICH_2CONHCH_2CH_2SO_3Na$ | 91.5% | 8.5% |
| 8 | 2-B | KI | 19.5% | 80.5% |
| 9 | 2-C | 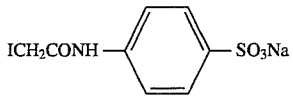 | 91% | 9% |

| Sample No. | Sensitivity | Fog | Response to pressure: ΔFog | Response to pressure: Pressure desensitization region | Remarks |
|---|---|---|---|---|---|
| 1 | 100 | 0.33 | 0.10 | 18% | Comparative example |
| 2 | 95 | 0.34 | 0.15 | 0% | Comparative example |
| 3 | 91 | 0.41 | 0.19 | 0% | Comparative example |
| 4 | 115 | 0.25 | 0.07 | 0% | Present invention |
| 5 | 115 | 0.26 | 0.07 | 0% | Present invention |
| 6 | 118 | 0.24 | 0.06 | 0% | Present invention |
| 7 | 115 | 0.25 | 0.06 | 0% | Present invention |
| 8 | 105 | 0.35 | 0.14 | 22% | Comparative example |
| 9 | 138 | 0.30 | 0.10 | 0% | Present invention |

Note that in Table 1, the sensitivities of the samples 2 to 9 are represented by a relative value assuming that the sensitivity of the sample 1 is 100.

The ratios of fringe-dislocation tabular grains and major face-dislocation tabular grains of each emulsion could be obtained by observing 200 emulsion grains for each emulsion by using a high-voltage electron microscope. (Each grain was observed at five different sample inclination angles of −10°, −5°, 0°, +5°, and +10°).

As is apparent from Table 1, the present invention in which 80% or more of silver halide grains had dislocation lines essentially at only their fringe portions made it possible to obtain an emulsion, which had a low fog and a high sensitivity, and in which an increase in pressure marks and pressure desensitization were small.

EXAMPLE 2

Layers having the compositions presented below were coated on subbed triacetylcellulose film supports to make samples 101 to 104 containing the emulsions 1-B, 1-G, 2-B, and 2-C, respectively, described in Example 1 in the fifth layer (red-sensitive emulsion layer) of a multilayered color light-sensitive material.

(Compositions of Light-Sensitive Layers)

The main materials used in the individual layers are classified as follows.

| | |
|---|---|
| ExC: Cyan coupler | UV: Ultraviolet absorbent |
| ExM: Magenta coupler | HBS: High-boiling organic solvent |
| ExY: Yellow coupler | H: Gelatin hardener |
| ExS: Sensitizing dye | |

The number corresponding to each component indicates the coating amount in units of $g/m^2$. The coating amount of a silver halide is represented by the amount of silver. The coating amount of each sensitizing dye is represented in units of moles per mole of a silver halide in the same layer.

(Samples 101–104)

| | | |
|---|---|---|
| **1st layer (Antihalation layer)** | | |
| Black colloidal silver | silver | 0.18 |
| Gelatin | | 1.40 |
| ExM-1 | | 0.18 |
| ExF-1 | | $2.0 \times 10^{-3}$ |
| HBS-1 | | 0.20 |
| **2nd layer (Interlayer)** | | |
| Emulsion G | silver | 0.065 |
| 2,5-di-t-pentadecylhydroquinone | | 0.18 |
| ExC-2 | | 0.020 |
| UV-1 | | 0.060 |
| UV-2 | | 0.080 |
| UV-3 | | 0.10 |

(Samples 101–104)

| | | |
|---|---|---|
| HBS-1 | | 0.10 |
| HBS-2 | | 0.020 |
| Gelatin | | 1.04 |
| 3rd layer (Low-speed red-sensitive emulsion layer) | | |
| Emulsion A | silver | 0.25 |
| Emulsion B | silver | 0.25 |
| ExS-1 | | $6.9 \times 10^{-5}$ |
| ExS-2 | | $1.8 \times 10^{-5}$ |
| ExS-3 | | $3.4 \times 10^{-4}$ |
| ExC-1 | | 0.17 |
| ExC-3 | | 0.030 |
| ExC-4 | | 0.10 |
| ExC-5 | | 0.020 |
| ExC-7 | | 0.0050 |
| ExC-8 | | 0.010 |
| Cpd-2 | | 0.025 |
| HBS-1 | | 0.10 |
| Gelatin | | 0.87 |
| 4th layer (Medium-speed red-sensitive emulsion layer) | | |
| Emulsion D | silver | 0.70 |
| ExS-1 | | $3.5 \times 10^{-4}$ |
| ExS-2 | | $1.6 \times 10^{-5}$ |
| ExS-3 | | $5.1 \times 10^{-4}$ |
| ExC-1 | | 0.13 |
| ExC-2 | | 0.060 |
| ExC-3 | | 0.0070 |
| ExC-4 | | 0.090 |
| ExC-5 | | 0.025 |
| ExC-7 | | 0.0010 |
| ExC-8 | | 0.0070 |
| Cpd-2 | | 0.023 |
| HBS-1 | | 0.10 |
| Gelatin | | 0.75 |
| 5th layer (High-speed red-sensitive emulsion layer) | | |
| Emulsion (one of 1-B, 1-G, 2-B, and 2-C) | | |
| | silver | 1.40 |
| ExC-1 | | 0.12 |
| ExC-3 | | 0.045 |
| ExC-6 | | 0.020 |
| ExC-8 | | 0.025 |
| Cpd-2 | | 0.050 |
| HBS-1 | | 0.22 |
| HBS-2 | | 0.10 |
| Gelatin | | 1.20 |
| 6th layer (Interlayer) | | |
| Cpd-1 | | 0.10 |
| HBS-1 | | 0.50 |
| Gelatin | | 1.10 |
| 7th layer (Low-speed green-sensitive emulsion layer) | | |
| Emulsion C | silver | 0.35 |
| ExS-4 | | $3.0 \times 10^{-5}$ |
| ExS-5 | | $2.1 \times 10^{-4}$ |
| ExS-6 | | $8.0 \times 10^{-4}$ |
| ExM-1 | | 0.010 |
| ExM-2 | | 0.33 |
| ExM-3 | | 0.086 |
| ExY-1 | | 0.015 |
| HBS-1 | | 0.30 |
| HBS-3 | | 0.010 |
| Gelatin | | 0.73 |
| 8th layer (Medium-speed green-sensitive emulsion layer) | | |
| Emulsion D | silver | 0.80 |
| ExS-4 | | $3.2 \times 10^{-5}$ |
| ExS-5 | | $2.2 \times 10^{-4}$ |
| ExS-6 | | $8.4 \times 10^{-4}$ |
| ExM-2 | | 0.13 |
| ExM-3 | | 0.030 |

(Samples 101–104)

| | | |
|---|---|---|
| ExY-1 | | 0.018 |
| HBS-1 | | 0.16 |
| HBS-3 | | $8.0 \times 10^{-3}$ |
| Gelatin | | 0.90 |
| 9th layer (High-speed green-sensitive emulsion layer) | | |
| Emulsion E | silver | 1.25 |
| ExS-4 | | $3.7 \times 10^{-5}$ |
| ExS-5 | | $8.1 \times 10^{-5}$ |
| ExS-6 | | $3.2 \times 10^{-4}$ |
| ExC-1 | | 0.010 |
| ExM-1 | | 0.030 |
| ExM-4 | | 0.040 |
| ExM-5 | | 0.019 |
| Cpd-3 | | 0.040 |
| HBS-1 | | 0.25 |
| HBS-2 | | 0.10 |
| Gelatin | | 1.44 |
| 10th layer (Yellow filter layer) | | |
| Yellow colloidal silver | silver | 0.030 |
| Cpd-1 | | 0.16 |
| HBS-1 | | 0.60 |
| Gelatin | | 0.60 |
| 11th layer (Low-speed blue-sensitive emulsion layer) | | |
| Emulsion C | silver | 0.18 |
| ExS-7 | | $8.6 \times 10^{-4}$ |
| ExY-1 | | 0.020 |
| ExY-2 | | 0.22 |
| ExY-3 | | 0.50 |
| ExY-4 | | 0.020 |
| HBS-1 | | 0.28 |
| Gelatin | | 1.10 |
| 12th layer (Medium-speed blue-sensitive emulsion layer) | | |
| Emulsion D | silver | 0.40 |
| ExS-7 | | $7.4 \times 10^{-4}$ |
| ExC-7 | | $7.0 \times 10^{-3}$ |
| ExY-2 | | 0.050 |
| ExY-3 | | 0.10 |
| HBS-1 | | 0.050 |
| Gelatin | | 0.78 |
| 13th layer (High-speed blue-sensitive emulsion layer) | | |
| Emulsion F | silver | 1.00 |
| ExS-7 | | $4.0 \times 10^{-4}$ |
| ExY-2 | | 0.10 |
| ExY-3 | | 0.10 |
| HBS-1 | | 0.070 |
| Gelatin | | 0.86 |
| 14th layer (1st protective layer) | | |
| Emulsion G | silver | 0.20 |
| UV-4 | | 0.11 |
| UV-5 | | 0.17 |
| HBS-1 | | $5.0 \times 10^{-2}$ |
| Gelatin | | 1.00 |
| 15th layer (2nd protective layer) | | |
| H-1 | | 0.40 |
| B-1 (diameter 1.7 μm) | | $5.0 \times 10^{-2}$ |
| B-2 (diameter 1.7 μm) | | 0.10 |
| B-3 | | 0.10 |
| S-1 | | 0.20 |
| Gelatin | | 1.20 |

In addition to the above components, to improve storage stability, processability, a resistance to pressure, antiseptic and mildewproofing properties, antistatic properties, and coating properties, the individual layers contained W-1 to W-3, B-4 to B-6, F-1 to F-17, iron salt, lead salt, gold salt, platinum salt, iridium salt, and rhodium salt.

TABLE 2

| Emulsion name | Average AgI content (%) | Average grain size (μm) | Variation coefficient (%) according to grain size | Diameter/thickness ratio | Silver amount ratio [core/intermediate/shell] (AgI content) | Grain structure/shape |
|---|---|---|---|---|---|---|
| Emulsion A | 4.0 | 0.45 | 27 | 1 | [1/3] (13/1) | Double structure octahedral grain |
| B | 8.9 | 0.70 | 14 | 1 | [3/7] (25/2) | Double structure octahedral grain |
| C | 2.0 | 0.55 | 25 | 7 | — | Uniform structure tabular grain |
| D | 9.0 | 0.65 | 25 | 6 | [12/59/29] (0/11/8) | Triple structure tabular grain |
| E | 9.0 | 0.85 | 23 | 5 | [8/59/33] (0/11/8) | Triple structure tabular grain |
| F | 14.5 | 1.25 | 25 | 3 | [37/63] (34/3) | Double structure tabular grain |
| G | 1.0 | 0.07 | 15 | 1 | — | Uniform structure fine grain |

In Table 2, (1) The emulsions A to F were subjected to reduction sensitization during grain preparation by using thiourea dioxide and thiosulfonic acid in accordance with the examples in JP-A-2-191938.

(2) The emulsions A to F were subjected to gold sensitization, sulfur sensitization, and selenium sensitization in the presence of the spectral sensitizing dyes described in the individual light-sensitive layers and sodium thiocyanate in accordance with the examples in JP-A-3-237450.

(3) The preparation of tabular grains was performed by using low-molecular weight gelatin in accordance with the examples in JP-A-1-158426.

(4) Dislocation lines as described in JP-A-3-23740 were observed in tabular grains and regular crystal grains having a grain structure when a high-voltage electron microscope was used.

(5) The emulsions A to G consisted of silver bromoiodide.

ExC-1

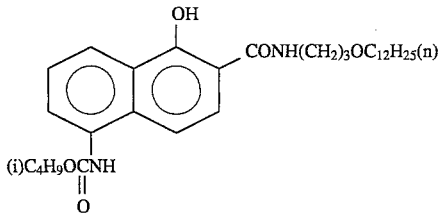

ExC-2

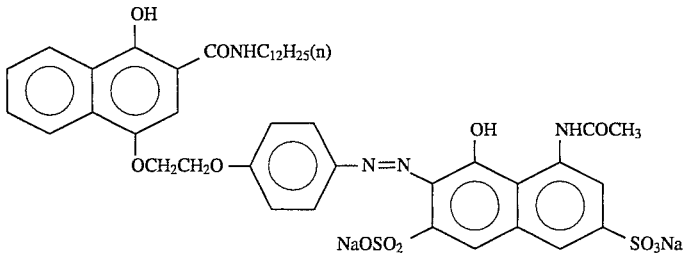

ExC-3

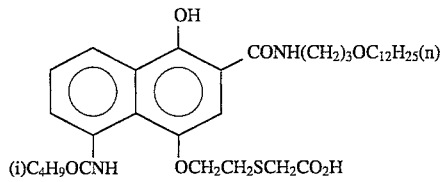

ExC-4

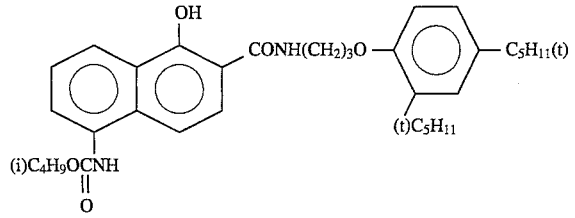

-continued
ExC-5
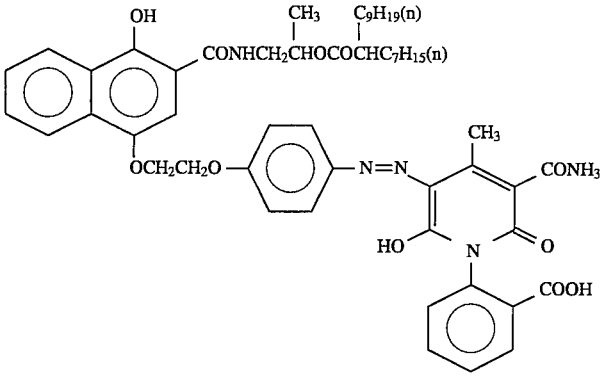
ExC-6
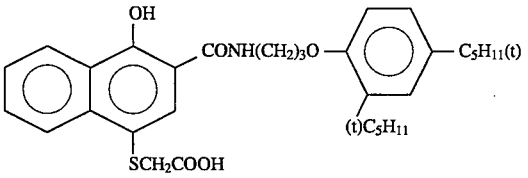
ExC-7
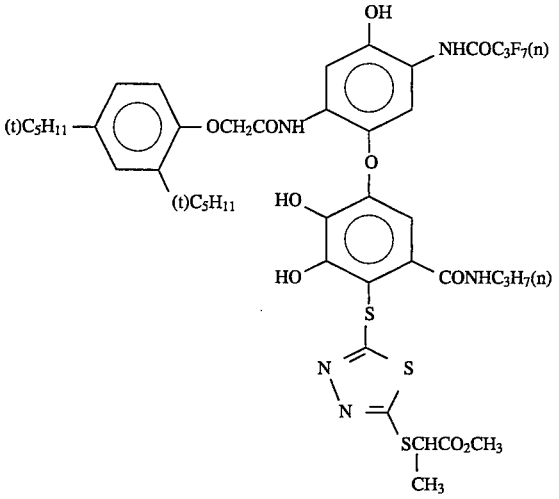
ExC-8
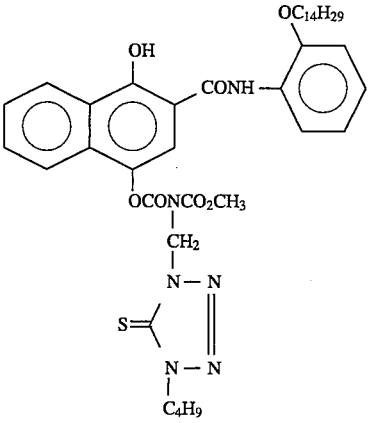

-continued
ExM-1
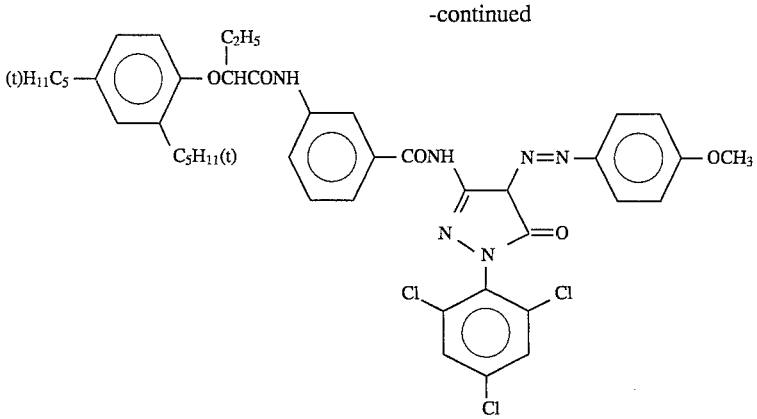
ExM-2
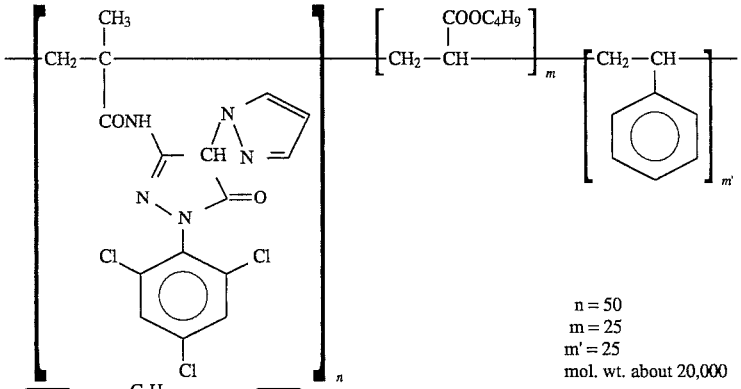
n = 50
m = 25
m' = 25
mol. wt. about 20,000
ExM-3
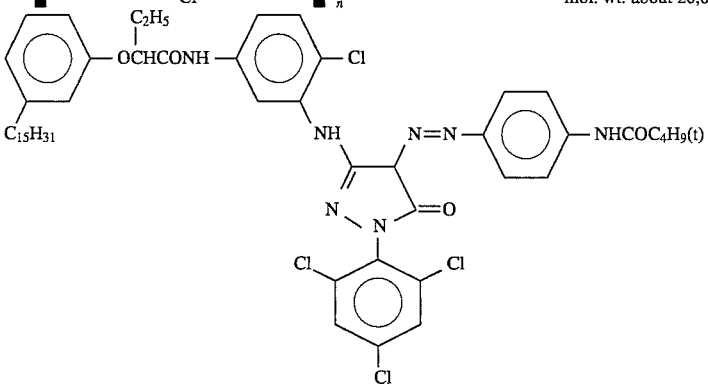
ExM-4
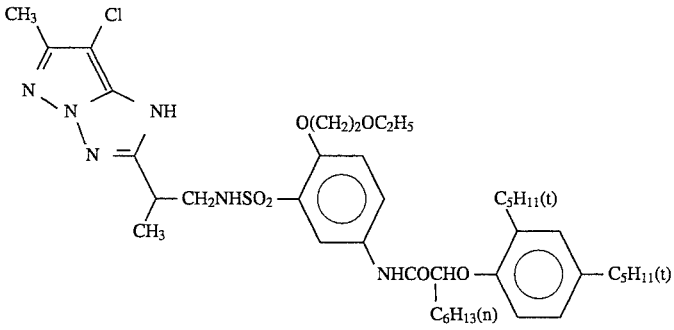

-continued
ExM-5
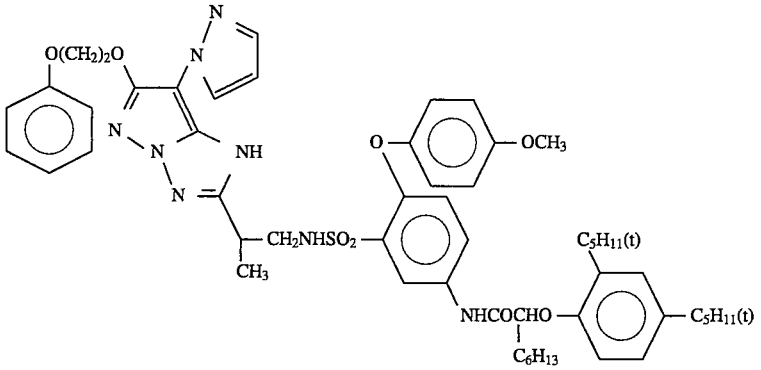
ExY-1
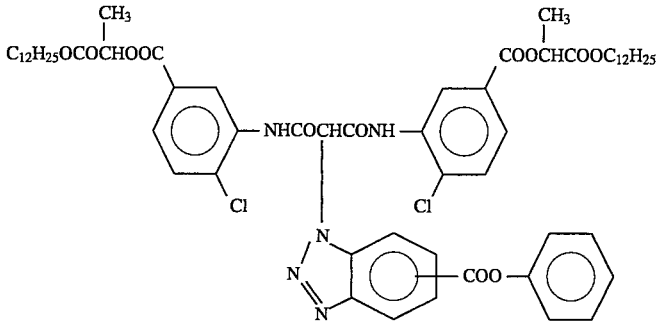
ExY-2
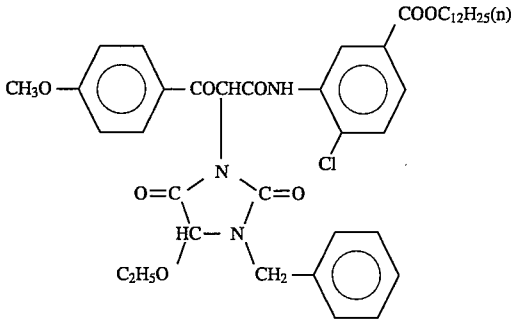
ExY-3
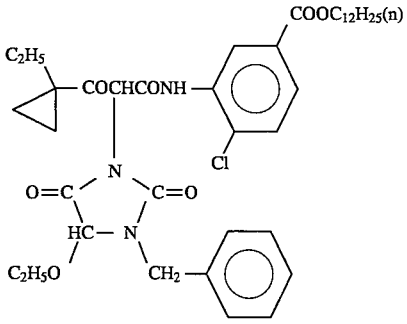
ExY-4
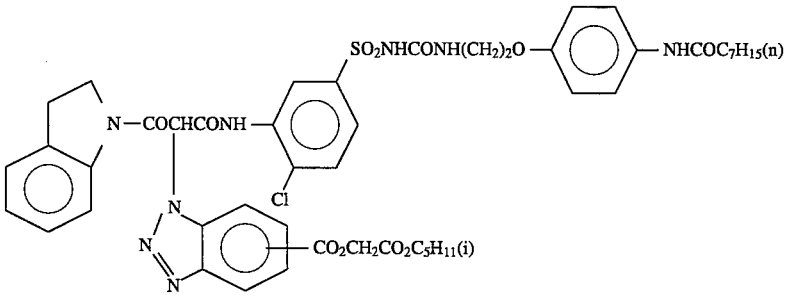

-continued
ExF-1
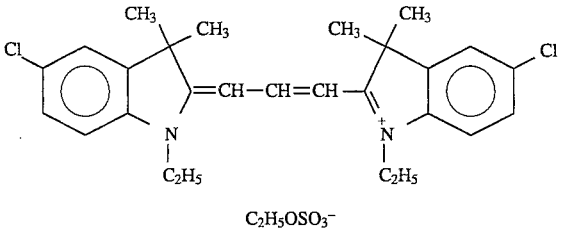
$C_2H_5OSO_3^-$
Cpd-1
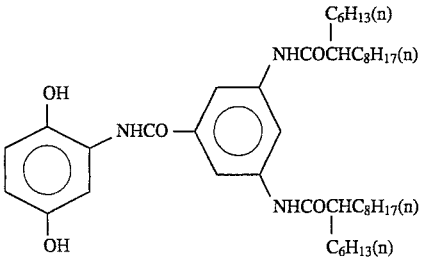
Cpd-2
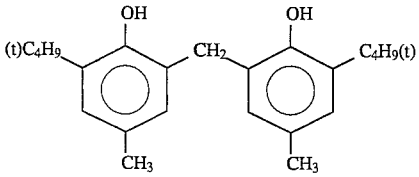
Cpd-3
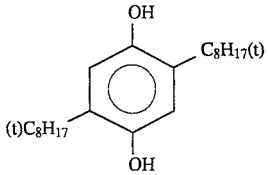
UV-1
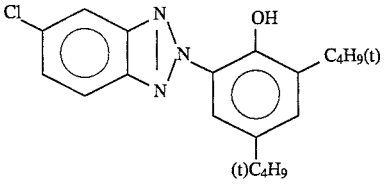
UV-2
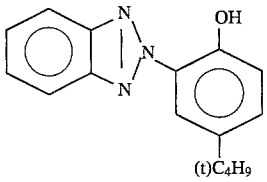
UV-3
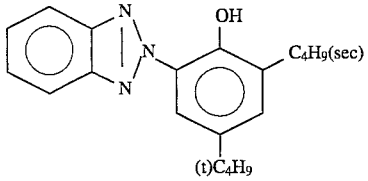
UV-4
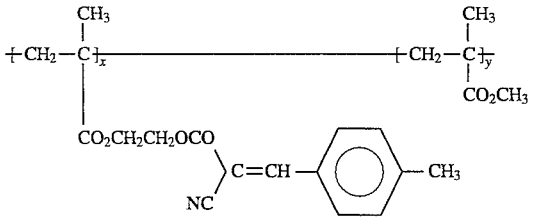
x:y = 70:30 (wt %)

-continued
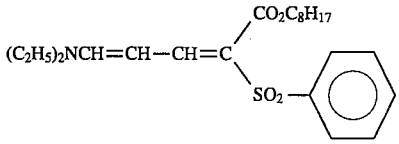
UV-5
Tricresyl phosphate HBS-1
Di-n-butyl phthalate HBS-2
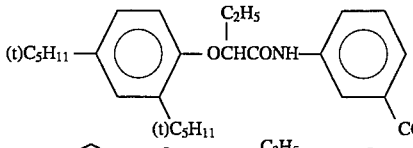
HBS-3
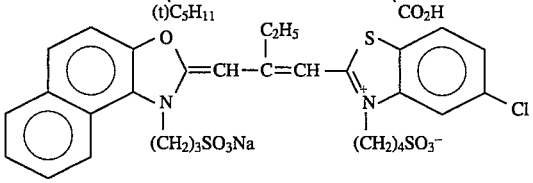
ExS-1
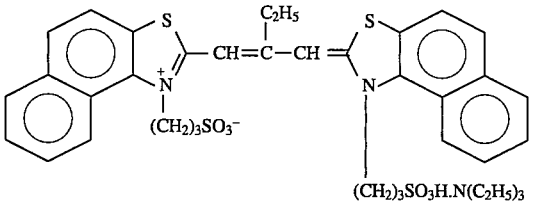
ExS-2
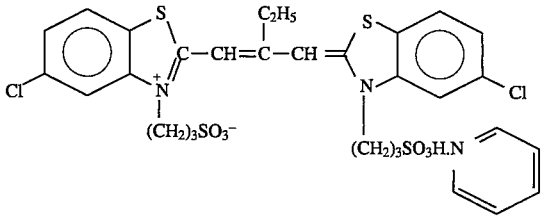
ExS-3
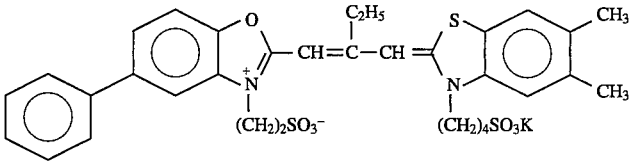
ExS-4
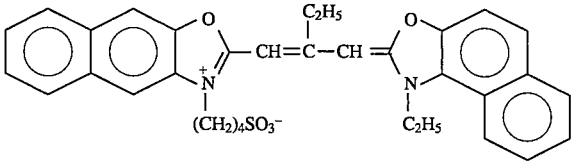
ExS-5
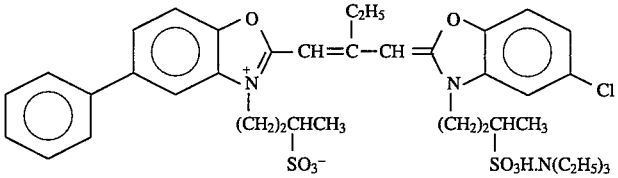
ExS-6

-continued
ExS-7
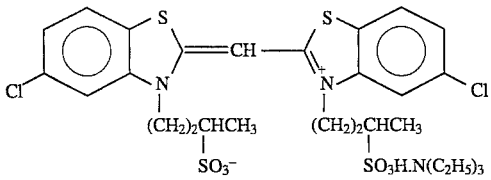
S-1
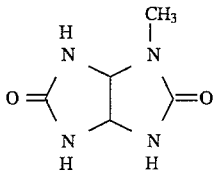
H-1
$CH_2{=}CH{-}SO_2{-}CH_2{-}CONH{-}CH_2$
$CH_2{=}CH{-}SO_2{-}CH_2{-}CONH{-}CH_2$
B-1
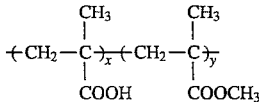
x/y = 10/90
B-2
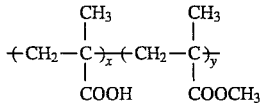
x/y = 40/60
B-3
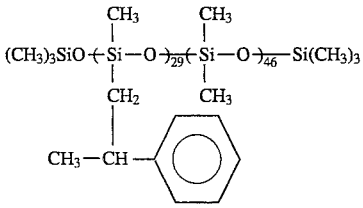
B-4
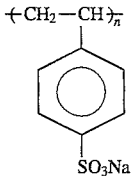
B-5
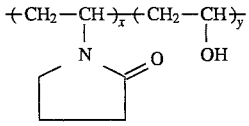
x/y = 70/30
B-6
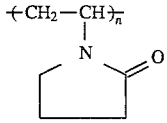
(mol. wt. about 10,000)
W-1
$C_8F_{17}SO_2NHCH_2CH_2CH_2OCH_2CH_2N^+(CH_3)_3$
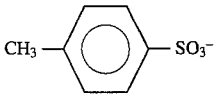
W-2
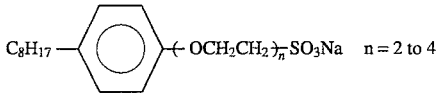
n = 2 to 4

-continued
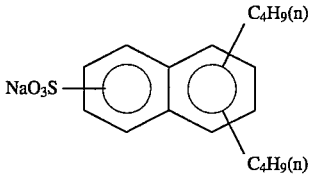
W-3
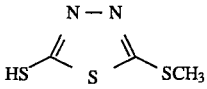
F-1
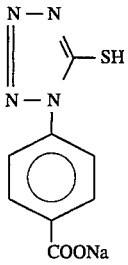
F-2
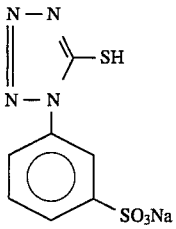
F-3
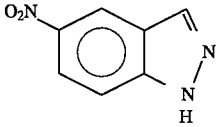
F-4
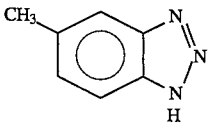
F-5
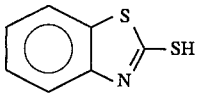
F-6
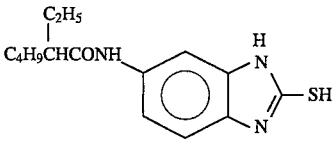
F-7
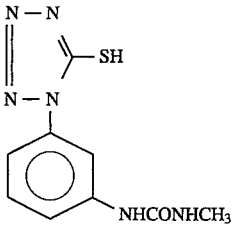
F-8
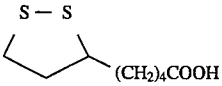
F-9

-continued

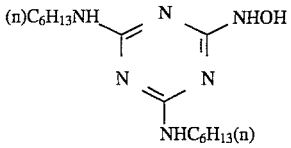

F-10

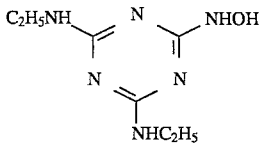

F-11

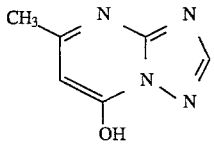

F-12

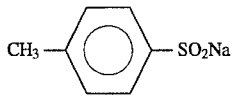

F-13

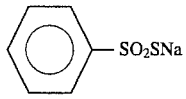

F-14

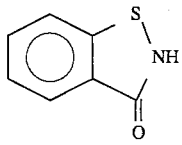

F-15

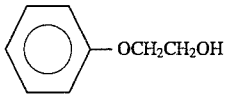

F-16

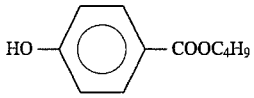

F-17

The samples 101 to 104 thus obtained were exposed and processed by the method described in Table C below.

TABLE C

| Processing Method | | |
|---|---|---|
| Process | Time | Temperature |
| Color development | 3 min. 15 sec. | 38° C. |
| Bleaching | 1 min. 00 sec. | 38° C. |
| Bleach-fixing | 3 min. 15 sec. | 38° C. |
| Washing (1) | 40 sec. | 35° C. |
| Washing (2) | 1 min. 00 sec. | 35° C. |
| Stabilization | 40 sec. | 38° C. |
| Drying | 1 min. 15 sec. | 55° C. |

The compositions of the individual processing solutions are given below.

| | (g) |
|---|---|
| (Color developing solution) | |
| Diethylenetriaminepentaacetate | 1.0 |
| 1-hydroxyethylidene-1,1-diphosphonic acid | 3.0 |

-continued

| | (g) |
|---|---|
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-ethyl-N-β-hydroxylethylamino)-2-methylaniline sulfate | 4.5 |
| Water to make | 1.0 l |
| pH | 10.05 |
| (Bleaching solution) | |
| Ferric ammonium ethylenediamine-tetraacetate dihydrate | 120.0 |
| Sodium ethylenediaminetetraacetate | 10.0 |
| Ammonium bromide | 100.0 |
| Ammonium nitrate | 10.0 |
| Bleaching accelerator $((CH_3)_2N—CH_2—CH_2—S—)_2.2HCl$ | 0.005 mole |
| Ammonia water (27%) | 15.0 ml |
| Water to make | 1.0 l |
| pH | 6.3 |
| (Bleach-fixing solution) | |
| Ferric ammonium ethylenediamine-tetraacetate dihydrate | 50.0 |
| Disodium ethylenediaminetetraacetate | 5.0 |

-continued

| | (g) |
|---|---|
| Sodium sulfite | 12.0 |
| Ammonium thiosulfate aqueous solution (70%) | 240.0 ml |
| Ammonia water (27%) | 6.0 ml |
| Water to make | 1.0 l |
| pH | 7.2 |

(Washing Solution)

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/l or less. Subsequently, 20 mg/l of sodium isocyanuric acid dichloride and 0.15 g/l of sodium sulfate were added. The pH of the solution ranged from 6.5 to 7.5.

| (Stabilizing solution) | (g) |
|---|---|
| Formalin (37%) | 2.0 ml |
| Polyoxyethylene-p-monononylphenylether (average polymerization degree = 10) | 0.3 |
| Disodium ethylenediaminetetraacetate | 0.05 |
| Water to make | 1.0 l |
| pH | 5.0–8.0 |

The fog density and the sensitivity which is represented by relative value of the reciprocal of exposure amount at which the density of fog density+0.2 are given, are obtained from a characteristic curve of a cyan dye.

The response to pressure was obtained by conducting the test method A following the same procedures as in Example 1. After exposure and development were performed, the densities of a portion applied with the pressure and a portion not applied with the pressure were measured in a characteristic curve of a cyan dye, thereby obtaining an increase in fog ΔFog caused by the pressure and a pressure desensitization region.

The obtained results are summarized in Table 3 below.

TABLE 3

| Sample No. | Emulsion | Sensitivity | Fog | Response to pressure ΔFog | Pressure sensitization region | Remarks |
|---|---|---|---|---|---|---|
| 101 | 1-B | 100 | 0.28 | 0.08 | 12% | Comparative example |
| 102 | 1-G | 118 | 0.17 | 0.05 | 0% | Present invention |
| 103 | 2-B | 105 | 0.30 | 0.12 | 15% | Comparative example |
| 104 | 2-C | 141 | 0.25 | 0.08 | 0% | Present invention |

Note that in Table 3, the sensitivities of the samples 102 to 104 are represented by a relative value assuming that the sensitivity of the sample 101 is 100.

As in Example 1, each emulsion of the present invention had a low fog, a high sensitivity, and an improved response to pressure, indicating the startling effect of the present invention.

EXAMPLE 3

Tabular silver bromoiodide emulsions were prepared following the same procedures as in Example 1 except equal molar quantities of compounds (2), (14), (15), (16), (19), and (63) were used in place of the compound (58) used in Example 1. The high sensitivity, the low fog, and the high response to pressure of each emulsion were approximately the same as those of the sample 3 (emulsion 1-D). In addition, another tabular emulsion was prepared following the same procedures as in Example 1 except a compound (22) was used in place of the compound (58) and the pH was raised from 5.0 to 7.0. This tabular emulsion also exhibited good results.

As has been described above, the present invention makes it possible to obtain a silver halide emulsion with a high sensitivity, a low fog, and an improved response to pressure.

What is claimed is:

1. A silver halide photographic light-sensitive material having a silver halide emulsion layer on a support, wherein said silver halide emulsion layer contains a silver halide emulsion in which silver halide tabular grains, which have an aspect ratio of 2 to 40 and in which dislocation lines are localized essentially to only fringe portions, occupy 100% to 80% of a total projected area of all grains, said silver halide tabular grains are formed while iodide ions are rapidly being generated, said iodide ions are rapidly generated from an iodide ion-releasing agent represented by Formula (I) below:

$$R—I \qquad (I)$$

where R represents a monovalent organic residue which releases the iodine atom, I, in the form of ions upon reacting with a base and/or a nucleophilic reagent.

2. The silver halide photographic light-sensitive material according to claim 1, wherein said iodide ions are generated from an iodide ion-releasing agent placed in a reaction vessel, and 50% to 100% of said iodide ion-releasing agent completes release of iodide ions within 180 consecutive seconds in the reaction vessel.

3. The silver halide photographic light sensitive material according to claim 2, wherein iodide ions released from the iodide ion-releasing agent are 0.1 to 20 mole % with respect to the total amount of silver halide.

4. The silver halide photographic light-sensitive material according to claim 1, wherein said iodide ions are generated by a reaction of an iodide ion-releasing agent with an iodide ion release-controlling agent.

5. The silver halide photographic light-sensitive material according to claim 1, wherein said reaction is a second-order reaction essentially proportional to a concentration of the iodide ion-releasing agent and a concentration of the iodide ion release-controlling agent, and a rate constant of the second-order reaction is 1,000 to $5\times10^{-3}M^{-1}sec^{-1}$.

6. The silver halide photographic light sensitive material according to claim 5, wherein the range of concentration of the iodide ion-releasing agent and the iodide ion release-controlling agent for use in the rapid production of iodide ions is $1\times10^{-7}$ to 20M.

7. The silver halide photographic light-sensitive material according to claim 1, wherein the aspect ratio is from 8 to 30.

8. The silver halide photographic light-sensitive material according to claim 1, wherein said tabular grains have a diameter in a range of from 0.3 to 10 μm.

9. The silver halide photographic light-sensitive material according to claim 1, wherein said tabular grains have a grain thickness in a range of from 0.05 to 1.0 μm.

10. The silver halide photographic light-sensitive material according to claim 1, wherein said tabular grains are hexagonal tabular grains in which a ratio of a length of a longest side of a hexagon to a length of a shortest side of a hexagon is 2 to 1.

11. The silver halide photographic light sensitive material according to claim 1, wherein a variation coefficient of a grain size distribution of all silver halide grains is 20% to 3%.

12. The silver halide photographic light sensitive material according to claim 1, wherein the tabular grains have 30 or more dislocations lines per grain in grain fringe portions of the tabular grains.

13. The silver halide photographic light sensitive material according to claim 1, wherein R is selected from the group consisting of an alkyl group having 1 to 30 carbon atoms, an alkenyl group having 2 to 30 carbon atoms, an alkynyl group having 2 or 3 carbon atoms, an aryl group having 6 to 30 carbon atoms, an aralkyl group having 7 to 30 carbon atoms, a heterocyclic group having 4 to 30 carbon atoms, an acyl group having 1 to 30 carbon atoms, a carbamoyl group, an alkyl or aryloxycarbonyl group having 2 to 30 carbon atoms, an alkyl or arylsulfonyl group having 1 to 30 carbon atoms, and a sulfamoyl group.

14. The silver halide photographic light sensitive material according to claim 1, wherein R is substituted and the substituents are selected from the group consisting of a halogen atom, an alkyl group, an alkenyl group, an alkynyl group, an aralkyl group, an aryl group, a heterocyclic group, an alkoxy group, an aryloxy group, an amino group, an acylamino group, a ureido group, a urethane group, a sulfonylamino group, a sulfamoylamino group, a carbamoyl group, a sulfonyl group, a sulfinyl group, an alkyloxycarbonyl group, an aryloxycarbonyl group, an acyl group, an acyloxy group, an amido-phosphoryl group, an alkylthio group, an arylthio group, a cyano group, a sulfo group, a carboxyl group, a hydroxy group, a phosphono group, and a nitro group.

15. The silver halide photographic light sensitive material according to claim 1, wherein said iodide ion-releasing agent represented by formula (I) is represented by Formula (II):

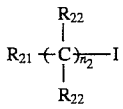

Formula (II)

wherein $R_{21}$ represents an electron-withdrawing group, each $R_{22}$ independently represents a hydrogen atom or is selected from the group consisting of an alkyl group having 1 to 30 carbon atoms, an alkenyl group having 2 to 30 carbon atoms, an alkynyl group having 2 or 3 carbon atoms, an aryl group having 6 to 30 carbon atoms, an aralkyl group having 7 to 30 carbon atoms, a heterocyclic group having 4 to 30 carbon atoms, an acyl group having 1 to 30 carbon atoms, a carbamoyl group, an alkyl or aryl oxycarbonyl group having 2 to 30 carbon atoms, an alkyl or arylsulfonyl group having 1 to 30 carbon atoms, and a sulfamoyl group, $n_2$ represents an integer from 1 to 6, and $R_{21}$ and $R_{22}$ or two or more $R_{22}$'s may combine together to form a 3- to 6-membered ring.

16. The silver halide photographic light sensitive material according to claim 15, wherein the electron-withdrawing group represented by $R_{21}$ is an organic group having a Hammett $\sigma_p$, $\sigma_m$, or $\sigma_I$ value larger than 0..

17. The silver halide photographic light sensitive material according to claim 15, wherein $R_{21}$ is selected from the group consisting of a halogen atom, a trichloromethyl group, a cyano group, a formyl group, a carboxylic acid group, a sulfonic acid group, a carbamoyl group, an acyl group, an oxycarbonyl group, a sulfonyl group, a sulfonyloxy group, a carbonyloxy group, a sulfamoyl group, and a heterocyclic group.

18. The silver halide photographic light sensitive material according to claim 15, wherein $R_{22}$ is substituted and the substituents are selected from the group consisting of a halogen atom, an alkyl group, an alkenyl group, an alkynyl group, an aralkyl group, an aryl group, a heterocyclic group, an alkoxy group, an aryloxy group, an amino group, an acylamino group, a ureido group, a urethane group, a sulfonylamino group, a sulfamoylamino group, a carbamoyl group, a sulfonyl group, a sulfinyl group, an alkyloxycarbonyl group, an aryloxycarbonyl group, an acyl group, an acyloxy group, an amido-phosphoryl group, an alkylthio group, an arylthio group, a cyano group, a sulfo group, a carboxyl group, a hydroxy group, a phosphono group, and a nitro group.

19. The silver halide photographic light sensitive material according to claim 1, wherein a compound represented by formula (I) is represented by Formula (III):

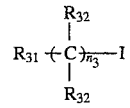

Formula (III)

$R_{31}$ represents an $R_{33}O$— group, an $R_{33}S$— group, an $(R_{33})_2N$— group, an $(R_{33})_2P$— group, or phenyl, wherein $R_{33}$ represents a hydrogen atom, an alkyl group having 1 to 30 carbon atoms, an alkenyl group having 2 to 30 carbon atoms, an alkynyl group having 2 or 3 carbon atoms, an aryl group having 6 to 30 carbon atoms, an aralkyl group having 7 to 30 carbon atoms, or a heterocyclic group having 4 to 30 carbon atoms; and if $R_{31}$ represents the $(R_{33})_2N$-group or the $(R_{33})_2P$— group, two $R_{33}$ groups may be the same or different; $R_{32}$ represents a hydrogen atom or is selected from the group consisting of an alkyl group having 1 to 30 carbon atoms, an alkenyl group having 2 to 30 carbon atoms, an alkynyl group having 2 or 3 carbon atoms, an aryl, group having 6 to 30 carbon atoms, an aralkyl group having 7 to 30 carbon atoms, a heterocyclic group having 4 to 30 carbon atoms, an acyl group having 1 to 30 carbon atoms, a carbamoyl group, an alkyl or aryloxycarbonyl group having 2 to 30 carbon atoms, an alkyl or arylsulfonyl group having 1 to 30 carbon atoms, and a sulfamoyl group, $n_3$ represents an integer from 1 to 6, and $R_{31}$ and $R_{32}$, or two or more $R_{32}$'s may bond together to form a ring.

20. The silver halide photographic light sensitive material according to claim 19, wherein $R_{22}$ is substituted and the substituents are selected from the group consisting of a halogen atom, an alkyl group, an alkenyl group, an alkynyl group, an aralkyl group, an aryl group, a heterocyclic group, an alkoxy group, an aryloxy group, an amino group, an acylamino group, a ureido group, a urethane group, a sulfonylamino group, a sulfamoylamino group, a carbamoyl group, a sulfonyl group, a sulfinyl group, an alkyloxycarbonyl group, an aryloxycarbonyl group, an acyl group, an acyloxy group, an amido-phosphoryl group, an alkylthio group, an arylthio group, a cyano group, a sulfo group, a carboxyl group, a hydroxy group, a phosphono group, and a nitro group.

21. The silver halide photographic light sensitive material according to claim 1, wherein a temperature during formation of silver halide grains is maintained in a range of 30° to 80° C.

22. The silver halide photographic light sensitive material according to claim 1, wherein a range of pH for controlling rate and timing at which iodide ions are being generated is from 2 to 12.

* * * * *